US012655629B2

(12) United States Patent
Nakayama et al.

(10) Patent No.: US 12,655,629 B2
(45) Date of Patent: Jun. 16, 2026

(54) SOUND-INSULATING STRUCTURAL BODY

(71) Applicant: Mitsubishi Chemical Corporation, Tokyo (JP)

(72) Inventors: Masanari Nakayama, Tokyo (JP); Yuya Saito, Tokyo (JP); Naoyuki Uchida, Tokyo (JP); Kazuma Inoue, Tokyo (JP); Haruki Koshitouge, Tokyo (JP)

(73) Assignee: Mitsubishi Chemical Corporation, Tokyo (JP)

( * ) Notice: Subject to any disclaimer, the term of this patent is extended or adjusted under 35 U.S.C. 154(b) by 384 days.

(21) Appl. No.: 18/125,500

(22) Filed: Mar. 23, 2023

(65) Prior Publication Data

US 2023/0250631 A1 Aug. 10, 2023

Related U.S. Application Data

(63) Continuation of application No. PCT/JP2021/035397, filed on Sep. 27, 2021.

(30) Foreign Application Priority Data

Sep. 25, 2020 (JP) ..... 2020-161356

(51) Int. Cl.
*E04B 1/84* (2006.01)

(52) U.S. Cl.
CPC ..... *E04B 1/84* (2013.01); *E04B 2001/8414* (2013.01)

(58) Field of Classification Search
CPC ..... E04B 1/84
(Continued)

(56) References Cited

U.S. PATENT DOCUMENTS 7,837,008 B1 * 11/2010 Lane ..... B64G 1/46 181/207
8,770,343 B2 * 7/2014 Mathur ..... B32B 3/12 428/116

(Continued)

FOREIGN PATENT DOCUMENTS

EP 0846812 A1 6/1998
JP 2000-265593 A 9/2000

(Continued)

OTHER PUBLICATIONS

International Preliminary Report on Patentability and Written Opinion issued in related International Patent Application No. PCT/JP2021/035397 dated Mar. 28, 2023.

(Continued)

*Primary Examiner* — Forrest M Phillips
(74) *Attorney, Agent, or Firm* — Morgan, Lewis & Bockius LLP

(57) ABSTRACT

An object of the present invention is to provide a sound-insulating structural body with which a high sound insulation effect can be obtained even when an uneven structural body having an uneven structure is disposed on a member having a high rigidity. Provided is a sound-insulating structural body including: a flexible member in which a load giving a deformation rate of 4% in a compression test performed by a compression tester is 160 kPa or less; an adherend on which the flexible member is disposed; and an uneven sheet member having an uneven structure that includes a sheet section and protruding parts provided on a surface of the sheet section. In this sound-insulating structural body, the flexible member is provided such that it is arranged between the adherend and the uneven sheet member.

19 Claims, 15 Drawing Sheets

(58) Field of Classification Search
USPC ..... 181/286
See application file for complete search history.

(56) References Cited

U.S. PATENT DOCUMENTS

| | | | | |
|---|---|---|---|---|
| 2011/0266088 | A1 | 11/2011 | Koike et al. | |
| 2013/0126267 | A1* | 5/2013 | Mathur | B32B 3/12 181/284 |
| 2018/0340328 | A1* | 11/2018 | Koga | B32B 27/20 |
| 2020/0005757 | A1* | 1/2020 | Ohtsu | G10K 11/172 |
| 2020/0124320 | A1* | 4/2020 | Sugawara | G10K 11/161 |
| 2021/0039361 | A1* | 2/2021 | Koshitouge | E04B 1/86 |
| 2021/0193101 | A1* | 6/2021 | Sugiura | B32B 25/12 |
| 2024/0029699 | A1* | 1/2024 | Inoue | G10K 11/16 |

FOREIGN PATENT DOCUMENTS

| | | | | |
|---|---|---|---|---|
| JP | 2010-229809 | A | 10/2010 | |
| JP | 2013-231316 | A | 11/2013 | |
| JP | 2017-227109 | A | 12/2017 | |
| KR | 10-2013-0111672 | A | 10/2013 | |
| TW | 201736693 | A | 10/2017 | |
| WO | WO-2005015539 | A1 * | 2/2005 | B60R 13/08 |
| WO | 2017/135409 | A1 | 8/2017 | |
| WO | 2020/162602 | A1 | 8/2020 | |

OTHER PUBLICATIONS

International Search Report issued in related International Patent Application No. PCT/JP2021/035397 dated Nov. 30, 2021.
Extended European Search Report issued Mar. 4, 2024 for European Patent Application No. 21872613.1.
Office Action issued in corresponding Chinese Patent Application No. 202180065563.7, dated May 17, 2025.
Office Action issued in corresponding Chinese Patent Application No. 202180065563.7, dated Nov. 8, 2025.
Decision of Rejection issued in corresponding Chinese Patent Application No. 202180065563.7, dated Jan. 29, 2026.
Office Action issued in corresponding European Patent Application No. 21872613.1, dated May 7, 2026.

* cited by examiner

SOUND-INSULATING STRUCTURAL BODY

CROSS-REFERENCE TO RELATED APPLICATION

This is a continuation of International Application PCT/JP2021/035397, filed on Sep. 27, 2021, and designated the U.S., and claims priority from Japanese Patent Application 2020-161356 which was filed on Sep. 25, 2020, the entire contents of which are incorporated herein by reference.

TECHNICAL FIELD

The present invention relates to a sound-insulating structural body which includes an uneven sheet member, a flexible member, and an adherend on which the flexible member is disposed.

BACKGROUND ART

Buildings such as housing complexes, office buildings, and hotels are required to offer quietness suitable for the use of their rooms by blocking the outside noise coming from automobiles, trains, airplanes, ships and the like, as well as equipment noise and human voice generated inside the buildings. Further, in vehicles such as automobiles, trains, airplanes, and ships, it is necessary to reduce the interior noise by blocking wind noise and engine noise so that passengers are provided with a quiet and comfortable space. Therefore, means for blocking the propagation of noise and vibration from outside to the inside of a room or from outside to the cabin of a vehicle, i.e. sound-insulating means, have been studied and developed. In recent years, sound-insulating members applicable to complex shapes are demanded for verticalization of buildings, improvement in the energy efficiency of vehicles, and improvement in the design freedom of buildings, vehicles, and their equipment.

Conventionally, the structures of sound-insulating members, particularly sheet-like members, have been refined for improvement of sound insulation performance. For example, a method of using plural rigid flat plate materials such as gypsum boards, concrete plates, steel sheets, glass plates, or resin plates in combination (Patent Document 1), a method of constructing a hollow double-wall or triple-wall structure using gypsum boards or the like (Patent Document 2), a method of using a combination of a flat plate material and plural independent stub-like projections (Patent Document 3), and a method of using a sound absorbing material in combination with a flat plate material and plural independent stub-like projections (Patent Document 4) are known.

RELATED ART DOCUMENTS

Patent Documents

[Patent Document 1] Japanese Unexamined Patent Application Publication No. 2013-231316

[Patent Document 2] Japanese Unexamined Patent Application Publication No. 2017-227109

[Patent Document 3] WO 2017/135409

[Patent Document 4] Japanese Unexamined Patent Application Publication No. 2000-265593

SUMMARY OF THE INVENTION

Problems to be Solved by the Invention

Among the above-described conventional sound-insulating members, the ones disclosed in Patent Documents 3 and 4, which are in a form that includes a sheet having a rubber elasticity and cylindrical projections arranged on a surface of the sheet in plural crisscross rows, are known to function by allowing the projections to resonate in response to an incoming sound and thereby provide sound insulation and vibration-damping performance beyond the law of mass.

In recent years, it is demanded that precision instruments, home electric appliances, and the like be equipped with a function of insulating low-frequency-band sound and vibration generated by themselves during use and, in order to meet such demands, the insulation performance has been examined by adjusting the material and size of projections also for the above-described sound-insulating members that are in the form of including an elastic sheet and cylindrical projections.

However, in order to enhance the sound insulation effect in a low-frequency band, it is necessary to increase the size of columnar projections and/or make the projections heavier by introducing weights thereto, and this inevitably leads to thickening, thus an increase in the size and weight of a sound-insulating member; therefore, the demand for insulation of low-frequency-band sound by installation of the sound-insulating member in a small and lightweight instrument cannot be satisfied.

In this respect, various studies have been conducted, and there has been developed a compact uneven sheets in which, as compared to conventional sound-insulating members, a high sound insulation effect can be obtained in a low-frequency band by arranging plural linear protruding parts in the form of rows along same direction on a highly rigid substrate, without having to increase the height of protruding parts on the substrate. It is surmised that such an arrangement allows the protruding parts to function as local (preferably local and periodic) rigidity and mass when sound is input thereto, and this excites a vibration mode corresponding to the distance between the protruding parts on the substrate portion and allows the substrate portion to vibrate in response to the input sound, as a result of which the sound insulation strength of the uneven sheet is improved. Moreover, it is made possible to freely adjust the sound insulation frequency band by designing, for example, the shape of the protruding parts on the substrate and the thickness of the substrate.

However, in the use of such an uneven sheet utilizing vibration of a substrate portion as a sound-insulating member, when the substrate portion is directly disposed on a highly rigid and hard member such as a metallic component or when a sound wave having a sufficient sound pressure does not enter the uneven sheet, the substrate portion cannot vibrate and the sound insulation performance is thus deteriorated; therefore, there is a problem that the usage of such an uneven sheet is limited. In other words, in the member disclosed in Patent Document 4, when its sound absorbing material has a high rigidity or when the sound absorbing material is thick and prevents a sound wave having a sufficient sound pressure from entering an uneven film, the sound insulation effect attributed to the uneven film disappears.

The present invention was made in view of the above-described problems, and an object of the present invention is to provide a sound-insulating structural body with which a high sound insulation effect can be obtained even when an uneven structural body having an uneven structure is disposed on a member having a high rigidity.

Means for Solving the Problems

The present inventors, in order to solve the above-described problems, intensively studied the configurations of sound-insulating structural bodies in which an uneven sheet member having a vibration mode effective for sound insulation is used as a substrate portion, and consequently discovered that, by using a combination of an uneven sheet member and a soft and easily deformable member as an uneven structural body having an uneven structure and taking into consideration the position of the uneven sheet member relative to a sound source, a sound insulation effect attributed to vibration of a sheet section of the uneven sheet member is exerted even on a member made of a metal or the like that has a high specific gravity and a high rigidity. In other words, the present inventors discovered that, when an uneven sheet member, a flexible member, and an adherend on which the flexible member is disposed are laminated in this order with respect to the direction of incoming sound, a high sound insulation performance is exerted in a sound insulation frequency band of the uneven sheet member, thereby solving the above-described problems.

That is, the gist of the present invention is as follows.

[1] A sound-insulating structural body, including:

a flexible member in which a load giving a deformation rate of 4% in a compression test performed by a compression tester is 160 kPa or less;

an adherend on which the flexible member is disposed; and an uneven sheet member having an uneven structure, wherein the flexible member is provided such that it is arranged between the adherend and the uneven sheet member.

[2] The sound-insulating structural body according to [1], wherein the uneven structure includes a sheet section and protruding parts provided on a surface of the sheet section, and the protruding parts and the sheet section have a weight ratio, which is represented by (weight of protruding parts/weight of sheet section), of 0.7 or higher.

[3] The sound-insulating structural body according to [2], including an adhesive layer between the uneven sheet member and the flexible member.

[4] The sound-insulating structural body according to [2] or [3], wherein the sheet section has an area density of 2.5 kg/m$^2$ or less.

[5] The sound-insulating structural body according to any one of [2] to [4], wherein the protruding parts have a density of 100 kg/m$^3$ or more.

[6] The sound-insulating structural body according to any one of [2] to [5], wherein the protruding parts have a height of 0.1 mm or more.

[7] The sound-insulating structural body according to any one of [2] to [6], wherein the protruding parts have a number ratio of 1,000 to 10,000/m$^2$.

[8] The sound-insulating structural body according to any one of [2] to [7], wherein the load giving a deformation rate of 4% in the compression test performed by the compression tester is 0.15 kPa or more.

[9] The sound-insulating structural body according to any one of [2] to [8], wherein in the uneven sheet member, the weight ratio of the protruding parts and the sheet section, which is represented by (weight of protruding parts/weight of sheet section), is 5 or lower, and in the flexible member, the load giving a deformation rate of 4% in the compression test performed by the compression tester is 10 kPa or less.

[10] The sound-insulating structural body according to any one of [2] to [9], wherein, in the uneven sheet member, the uneven structure is provided on the surface of the side on which the flexible member exists, or the opposite side thereof.

[11] The sound-insulating structural body according to any one of [2] to [10], which is used together with a sound source and installed such that the side of the uneven sheet member faces the sound source.

[12] The sound-insulating structural body according to any one of [2] to [11], satisfying the conditions represented by the following equations (A) to (C) simultaneously:

$$(TL_1-TL_2)-(TL_3-TL_4)>3\text{ dB} \quad (A)$$

$$TL_1-TL_2>0\text{ dB} \quad (B)$$

$$TL_3-TL_4>0\text{ dB} \quad (C)$$

$TL_1$ (dB): sound transmission loss of the sound-insulating structural body in a case where the side of the uneven sheet member is arranged to face the sound source $TL_2$ (dB): sound transmission loss of the sound-insulating structural body in a case where, under the condition of the $TL_1$, the uneven sheet member is replaced with a smooth flat sheet having the same mass and area $TL_3$ (dB): sound transmission loss of the sound-insulating structural body in a case where the side of the adherend is arranged to face the sound source $TL_4$ (dB): sound transmission loss of the sound-insulating structural body in a case where, under the condition of the $TL_3$, the uneven sheet member is replaced with a smooth flat sheet having the same mass and area wherein the $TL_1$ and the $TL_2$ each represent the sound transmission loss at a frequency at which the value of $(TL_1-TL_2)$ is the largest, and the $TL_3$ and the $TL_4$ each represent the sound transmission loss at a frequency at which the value of $(TL_3-TL_4)$ is the largest.

[13] The sound-insulating structural body according to any one of [2] to [12], wherein the uneven sheet member includes a sheet section and protruding parts linearly protruding on the sheet section, and uneven unit shapes which have the protruding parts and recessed parts extending along the protruding parts are repeatedly arrayed in one or two directions on the sheet section.

[14] The sound-insulating structural body according to any one of [2] to [13], wherein the flexible member is a nonwoven fabric.

[15] The sound-insulating structural body according to any one of [2] to [13], wherein the flexible member is a foamed body.

[16]A sound-insulating sheet, including:

an uneven sheet member having an uneven structure which includes a sheet section and plural protruding parts provided on a surface of the sheet section; and a flexible member provided on the uneven sheet member, wherein in the flexible member, a load giving a deformation rate of 4% in a compression test performed by a compression tester is 160 kPa or less, and in the uneven sheet member, the protruding parts and the sheet section have a weight ratio, which is represented by (weight of protruding parts/weight of sheet section), of 0.7 or higher.

Effects of the Invention

According to the present invention, a sound-insulating structural body with which a high sound insulation effect can be obtained even when an uneven structural body having an uneven structure is disposed on a member having a high rigidity can be provided.

MODE FOR CARRYING OUT THE INVENTION

Figure 1:
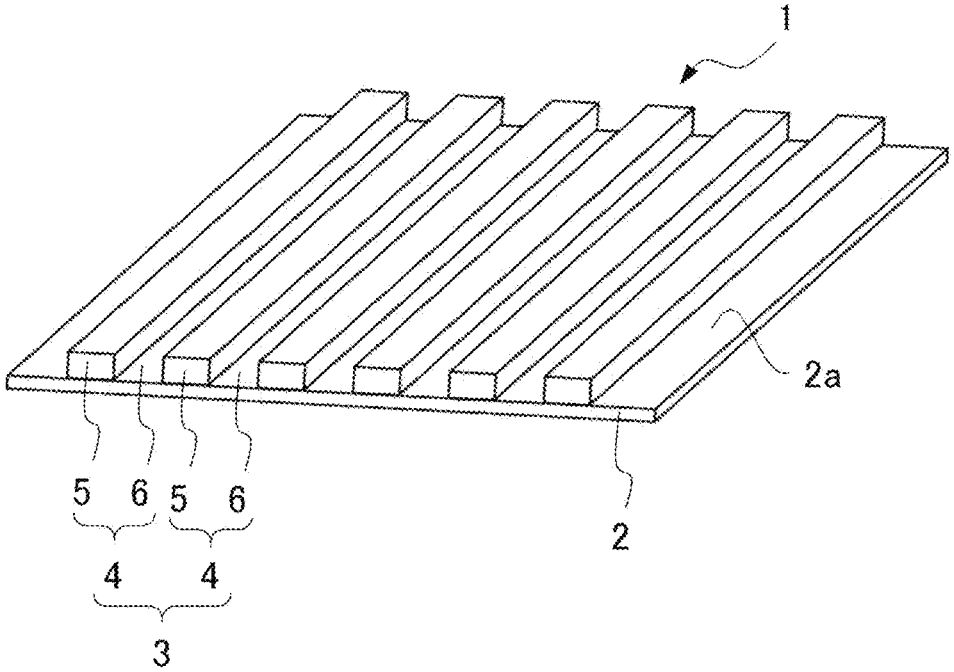
FIG. 1 is a schematic perspective view that illustrates one embodiment of the uneven sheet member according to one embodiment of the present invention.

The present invention will now be described in detail. The following descriptions are merely examples (representative examples) of the present invention, and the present invention is not limited thereto. Further, modifications can be arbitrarily made to carry out the present invention, without departing from the gist of the present invention.

In the present specification, those ranges stated with "to" each denote a range that includes the numbers stated before and after "to".

In the present specification, "plural" means two or more.

<Sound-Insulating Structural Body>

The sound-insulating structural body according to one embodiment of the present invention (hereinafter, also simply referred to as "sound-insulating structural body") is a sound-insulating structural body including:

- a flexible member in which a load giving a deformation rate of 4% in a compression test performed by a compression tester is 160 kPa or less;
- an adherend on which the flexible member is disposed; and
- an uneven sheet member having an uneven structure,
- wherein the flexible member is provided such that it is arranged between the adherend and the uneven sheet member.

Since the above-described sound-insulating structural body can ensure a high sound insulation effect despite its simple configuration, not only an increase in its size can be inhibited, but also a sheet section disposed on the flexible member receives only limited vibration inhibition from a member in contact therewith; therefore, a high sound insulation effect can be obtained also for sound waves having a relatively low sound pressure.

In addition, when the sound-insulating structural body is used together with a sound source, a higher sound insulation effect can be obtained in a mode in which the uneven sheet member side is arranged to face the sound source than in a mode in which the adherend side is arranged to face the sound source. This is believed to be because a sound wave having a higher sound pressure enters the uneven sheet member and causes the sheet section to vibrate efficiently.

Moreover, the frequency of the sound to be insulated can be adjusted by adjusting the shape of protruding parts, the distance between protruding parts, the thickness of the sheet section, and the like.

The term "flexible member" used herein refers to a member in which, as described below, a load giving a deformation rate of 4% in a compression test is 160 kPa or less.

Further, in the present specification, "mass" and "weight" are synonymous, and "mass" may be read as "weight".

Embodiments of the present invention will now be described referring to the drawings. It should be noted here, however, that the below-described embodiments are merely examples for describing the present invention, and the present invention is not limited only to the below-described embodiments.

[Uneven Sheet Member]

(Configuration of Uneven Sheet Member)

Figure 2:
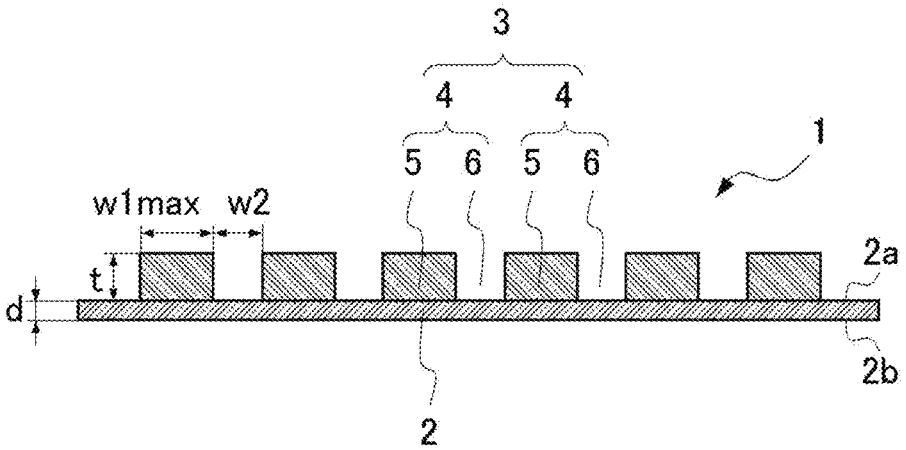
FIG. 2 is a schematic lateral cross-sectional view of the uneven sheet member of FIG. 1.
Figure 9:
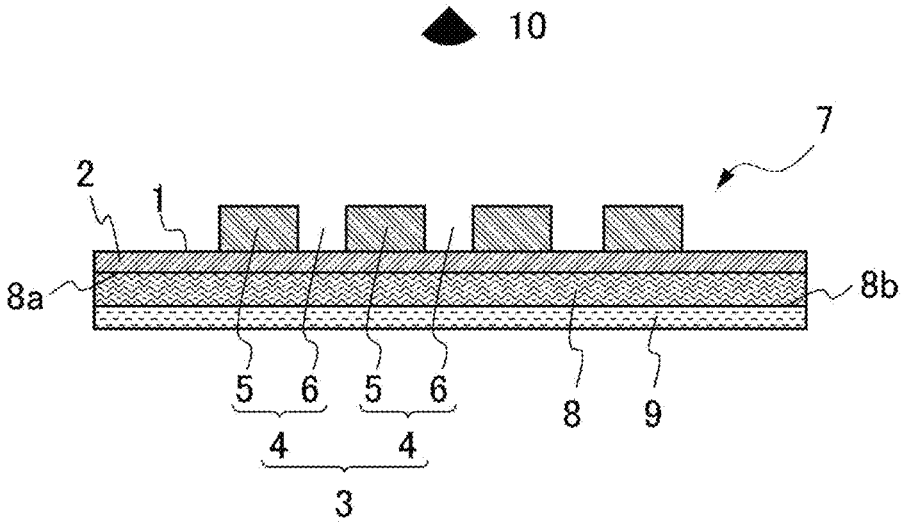
FIG. 9 is a schematic cross-sectional view that illustrates one embodiment of the sound-insulating structural body according to one embodiment of the present invention.

FIGS. 1 and 2 are a schematic perspective view and a schematic lateral cross-sectional view of an uneven sheet member 1, respectively, and FIG. 9 is a schematic cross-sectional view of the sound-insulating structural body of the present embodiment. The uneven sheet member 1 in the illustrated form has an uneven structure 3, specifically an uneven structure that includes a sheet section 2 and protruding parts 5 provided on a surface of the sheet section, and the uneven structure 3 may be provided on the surface of the side on which the above-described flexible member exists, or the opposite side thereof. More specifically, the uneven structure 3 is configured such that the protruding parts 5 linearly extending between the opposing long sides of the sheet section 2 are arranged in plural rows on a surface 2*a* of one side of the sheet-like sheet section 2 (the surface on the opposite side of the side on which the flexible member exists); however, the uneven structure may also be configured such that the protruding parts 5 are arranged on a surface 2*b* which is the surface on the opposite side of the surface 2*a* of the sheet section (the surface of the side on which the flexible member exists), or on both of these surfaces. In the uneven structure 3, each protruding part 5 linearly extending on the surface of the sheet section 2 and a recessed part 6 which is a flat part adjacent to the protruding part 5 constitute a single uneven unit shape 4, and this uneven unit shape 4 is repeatedly arranged in plural rows between the opposing short sides of the sheet section 2.

A sound-insulating structural body 7 illustrated in FIG. 9 is formed by arranging a flexible member 8 on the surface 2*b* of the sheet section 2 on the side that is not provided with the uneven structure 3, and further arranging an adherend 9 on a surface 8*b* of one side of the flexible member 8 that is not provided with the uneven sheet member 1.

Figure 6:
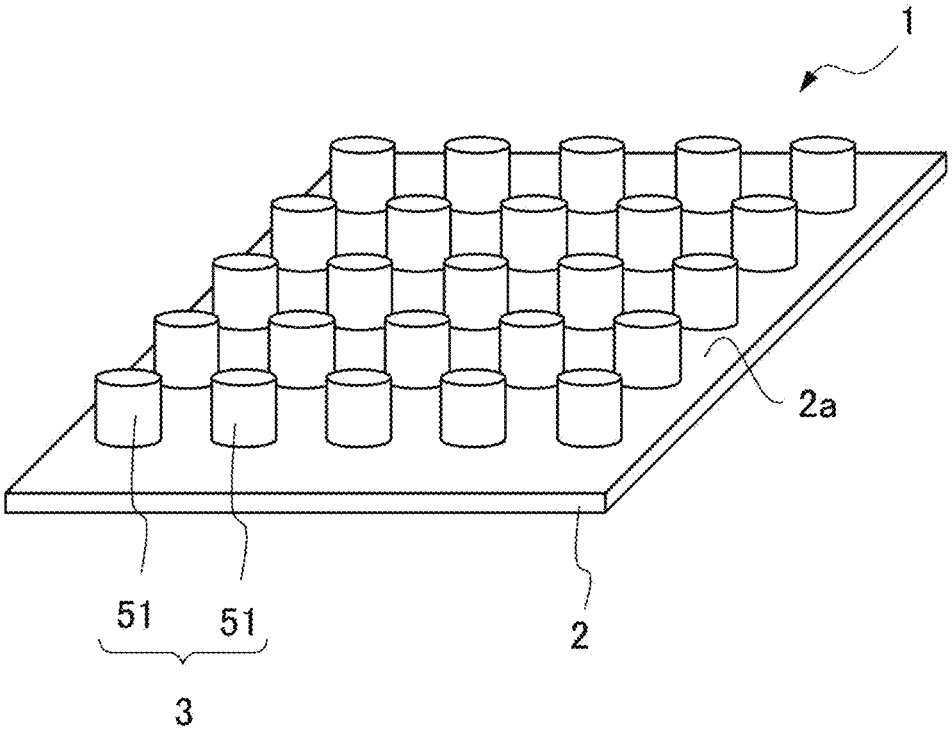
FIG. 6 is a schematic perspective view that illustrates yet another embodiment of the uneven sheet member according to one embodiment of the present invention.

The uneven structure 3 may be a linear uneven structure as illustrated in FIGS. 1 and 2, or may be a dot-like uneven structure as illustrated in FIG. 6.

The sheet section 2 according to the present embodiment is used for supporting the protruding parts 5. By providing plural protruding parts 5 on the sheet section 2, protruding parts and recessed parts are created, and the uneven structure 3 is formed. The material constituting the sheet section 2 is not particularly limited as long as it can support the protruding parts 5, and may be the same as or different from the material constituting the protruding parts 5; however, from the standpoint of supporting plural protruding parts 5, it is preferred to use a material that has a higher rigidity than a resin used for the formation of the protruding parts 5.

Specifically, the sheet section 2 has a Young's modulus of preferably 1 GPa or more, more preferably 1.5 GPa or more. An upper limit of the Young's modulus is not particularly limited; however, it is, for example, 1,000 GPa or less.

The sheet section 2, from the standpoint of exciting a vibration mode effective for sound insulation thereon, has an area density of preferably 2.5 $kg/m^2$ or less, more preferably 2.0 $kg/m^2$ or less, and the area density is preferably not less than 0.06 $kg/m^2$ from the standpoint of the ease of handling of the sheet section.

Specific examples of the material constituting the sheet section 2 include, but not particularly limited to: organic materials, such as polyacrylonitrile, polyethylene terephthalate, polybutylene terephthalate, polyethylene naphthalate, polyvinyl chloride, polyvinylidene chloride, polychlorotrifluoroethylene, polyethylene, polypropylene, polystyrene, cyclic polyolefin, polynorbornene, polyether sulfone, polyether ether ketone, polyphenylene sulfide, polyarylate, polycarbonate, polyamide, polyimide, triacetylcellulose, epoxy resins, acrylic resins, and oxazine resins; and composite materials containing a metal (e.g., aluminum, stainless steel, iron, copper, zinc, or brass), an inorganic glass, or inorganic particles or fibers in the above-exemplified organic materials. Thereamong, polyethylene terephthalate is preferred from the standpoint of sound insulation performance, rigidity, moldability, cost, and the like.

The sheet section 2 may take a mode of being constituted by a single layer or a mode of being constituted by two or more plural layers that are laminated and, when the sheet section 2 is in the mode of being constituted by two or more plural layers that are laminated, the conditions of the sheet section 2 in the present specification are those of a laminated body unless otherwise specified.

The sheet section 2 has a thickness d of preferably 30 μm or more and 500 μm or less, more preferably 40 μm or more and 400 μm or less, still more preferably 45 μm or more and 300 μm or less. When the thickness of the sheet section 2 is 30 μm or more, the sheet section 2 has excellent ease of handling, while when the thickness of the sheet section 2 is 500 μm or less, the sound insulation performance exerted by providing the protruding parts 5 can be improved.

From the standpoint of preventing an incident sound from reaching a spot to be sound-insulated without passing through an uneven sheet member, the area of the sheet section 2 is required to be equal to or larger than the area of the spot to be sound-insulated.

The shape of the sheet section 2 is not limited to the mode illustrated in FIGS. 1 and 2, and can be set as appropriate in accordance with the surface on which the uneven sheet member 1 is to be arranged. For example, the sheet section 2 may have a flat sheet-like shape, a curved sheet-like shape, or a special shape processed to have a curved portion, a bent portion, or the like. Further, from the standpoint of weight reduction and the like, for example, a notch or a punched hole may be formed at any position of the sheet section 2.

When the sheet section 2 is used by being pasted to the flexible member 8, one or both of the surfaces 2*a* and 2*b* of the sheet section 2 may have a pressure-sensitive adhesive layer or the like.

A method of producing the sheet section 2 and the protruding parts 5 is not particularly limited and, as described below, the sheet section 2 and the protruding parts 5 may be molded as separate materials and then adhered, or may be integrally molded; however, when the sheet section 2 and the protruding parts 5 are molded as separate materials and then adhered, those parts of the sheet section 2 to be adhered with the protruding parts 5, and/or those parts of the protruding parts 5 to be adhered with the sheet section 2 may have a pressure-sensitive adhesive layer.

The protruding parts 5 constituting the uneven structure 3 play a role in imparting the sheet section 2 with local (preferably local and periodic) rigidity and mass. By imparting the sheet section 2 with local rigidity and mass (preferably in a periodic manner), a function of exciting a vibration mode corresponding to the distance between the protruding parts on the sheet section 2 is exerted when a sound wave is input thereto from a sound source.

It is believed that the mechanism of sound insulation by a sound-insulating sheet having plural cylindrical protruding parts, which is described in the aforementioned Patent Documents 3 and 4, is attributed to an increase in dynamic mass as a result of resonance of each protruding part in response to an incoming sound wave having a specific frequency. Meanwhile, in the uneven sheet member 1, it is believed that vibration of the sheet section 2 functions as a mechanism of sound insulation. In other words, the protruding parts 5 impart the sheet section 2 with local (preferably local and periodic) rigidity and mass and thereby excite a vibration mode corresponding to the distance between the protruding parts, and a sound insulation effect can be exerted at a specific frequency by means of vibration of the sheet section 2.

Depending on the thickness of the sheet section, the mass of the protruding parts, and the like, the shape of the uneven structure 3 is not limited to a linear shape, and local (preferably local and periodic) rigidity and mass can be provided effectively by using cylindrical or dot-like protruding parts.

A method of forming the uneven structure 3 is not particularly limited, and the uneven structure 3 may be formed by modifying the shape of the sheet section 2, for example, modifying the shape of a sheet that does not have an uneven structure by pressing a mold having cavities of an uneven structure against the sheet. Alternatively, the uneven structure 3 may be integrally formed as the protruding parts 5 on the sheet section 2 using a material different from that of the sheet section 2, for example, by pouring raw materials into cavities having an uneven structure and then molding, or may be formed by separately preparing the protruding parts and the sheet section and subsequently adhering them using an adhesive material. Further, the uneven structure 3 may be formed on one surface of the sheet section 2, or may be formed on plural surfaces of the sheet section 2; however, the present inventors presume that the uneven structure 3 be preferably formed on one surface of the sheet section 2 from the standpoint of obtaining stable sound insulation performance.

As the cross-sectional shape of the protruding parts 5 perpendicular to the arrangement direction, i.e. the lateral cross-sectional shape of the protruding parts 5, generally, a square shape, a rectangular shape, a trapezoidal shape, a semicircular shape, a semielliptical shape, or the like can be employed. The cross-sectional shape of the protruding parts 5 may be selected as appropriate in accordance with the intended use from the standpoint of, for example, sound insulation performance, production cost, and ease of handling.

A maximum width w1max at a cross-section perpendicular to the arrangement direction of the uneven unit shapes 4, i.e. a maximum width w1max of the lateral cross-section of the protruding parts 5, is preferably 0.5 mm or more and 10 mm or less, more preferably 0.7 mm or more and 8 mm or less, still more preferably 1 mm or more and 6 mm or less. When the maximum width w1max is in this range, an uneven sheet member 1 that is thin and lightweight and has excellent sound insulation performance in a low-frequency band can be obtained.

The height of the uneven unit shapes 4, i.e. the height t of the protruding parts 5, is preferably 0.5 mm or more and 10 mm or less, more preferably 0.7 mm or more and 8 mm or less, still more preferably 1 mm or more and 6 mm or less. When the height t is in this range, an uneven sheet member 1 that is thin and lightweight and has excellent sound insulation performance in a low-frequency band can be obtained.

The gap between the uneven unit shapes 4, i.e. the width (w2) of the recessed parts 6, is preferably 3 mm or more and 100 mm or less, more preferably 4 mm or more and 80 mm or less, still more preferably 5 mm or more and 50 mm or less. When the width (w2) is in this range, an uneven sheet member 1 that is lightweight and has excellent sound insulation performance in a low-frequency band can be obtained.

In the sound-insulating structural body 7 having the above-described configuration, from the standpoint of obtaining a high sound insulation effect also for a sound wave having a relatively low sound pressure, it is preferred that the uneven sheet member 1 include the sheet section 2 and the protruding parts 5 linearly protruding on the sheet section 2, and that uneven unit shapes which have the protruding parts 5 and the recessed parts 6 extending along the protruding parts 5 be repeatedly arrayed in one direction or two directions on the sheet section 2.

Further, when the specific gravity of the protruding parts 5 is denoted as "sg", the uneven structure 3 is preferably formed such that the maximum width w1max (mm) of the lateral cross-section of the protruding parts 5, the height t (mm) of the protruding parts 5, and the width w2 (mm) of the recessed parts 6 are in ranges defined by the following equations (I) and (II):

$$0.1 \le w1\max \times t \times sg/w2 \le 10 \quad \text{(I)}$$

$$5 \le w1\max \times t \le 50 \quad \text{(II)}$$

In the production of the uneven sheet member 1, as described above, the configuration of the uneven unit shapes 4 that gives a high sound insulation performance varies in terms of optimum values depending on the relationship of the thickness d of the sheet section 2, the size of the protruding parts 5, the size of the recessed parts 6, and the like; however, the uneven sheet member 1 can exert a good sound insulation effect as long as it is formed in the ranges of the equation (I) defining the area density of the uneven unit shapes 4 and the equation (II) defining the cross-sectional area of the protruding parts 5. When these values are smaller than the respective lower limit values of the ranges defined by the above equations, the sound insulation strength is reduced, while when the values are larger than the respective upper limit values, the sound insulation performance in a low-frequency band cannot be obtained.

The weight ratio of the protruding parts 5 and the sheet section 2, which is represented by (weight of protruding parts 5/weight of sheet section 2), is preferably in a range of 0.1 or more and 50 or less, more preferably 0.5 or more and 30 or less, still more preferably 0.7 or higher, particularly preferably 1.0 or more and 20 or less, most preferably 2.0 or higher. By controlling the weight ratio of the protruding parts 5 and the sheet section 2 to be in this range, the protruding parts 5 are allowed to more effectively function as local (preferably local and periodic) rigidity and mass against the vibration of the sheet section 2, so that the sound insulation strength in a low-frequency band can be effectively increased.

When "a load giving a deformation rate of 4% in a compression test performed by a compression tester is 160 kPa or less" in the flexible member to which an uneven sheet member is pasted, specific vibration of the uneven sheet member is not inhibited, so that a sufficient sound insulation effect can be obtained.

When the weight ratio of the protruding parts and the sheet section, which is represented by (weight of protruding parts 5/weight of sheet section 2), is in a range of 5 or lower, it is more important not to inhibit the vibration of the uneven sheet member; therefore, the load giving a deformation rate of 4% in a compression test performed by a compression tester is preferably 10 kPa or less.

The area ratio of the protruding parts 5 and the recessed parts 6, which is represented by (area of protruding parts 5/area of recessed parts 6), is preferably in a range of 0.1 or more and 3 or less, more preferably 0.15 or more and 2 or less, still more preferably 0.2 or more and 1.5 or less. By controlling the area ratio to be in this range, the protruding parts 5 are allowed to more effectively function as local rigidity and mass against the vibration of the sheet section 2, so that the sound insulation strength in a low-frequency band can be effectively increased. It is noted here that the "area of protruding parts" refers to an area occupied by the protruding parts with respect to the entirety of a single sheet section, and the "area of recessed parts" refers to an area occupied by the recessed parts with respect to the entirety of a single sheet section.

Figure 3:
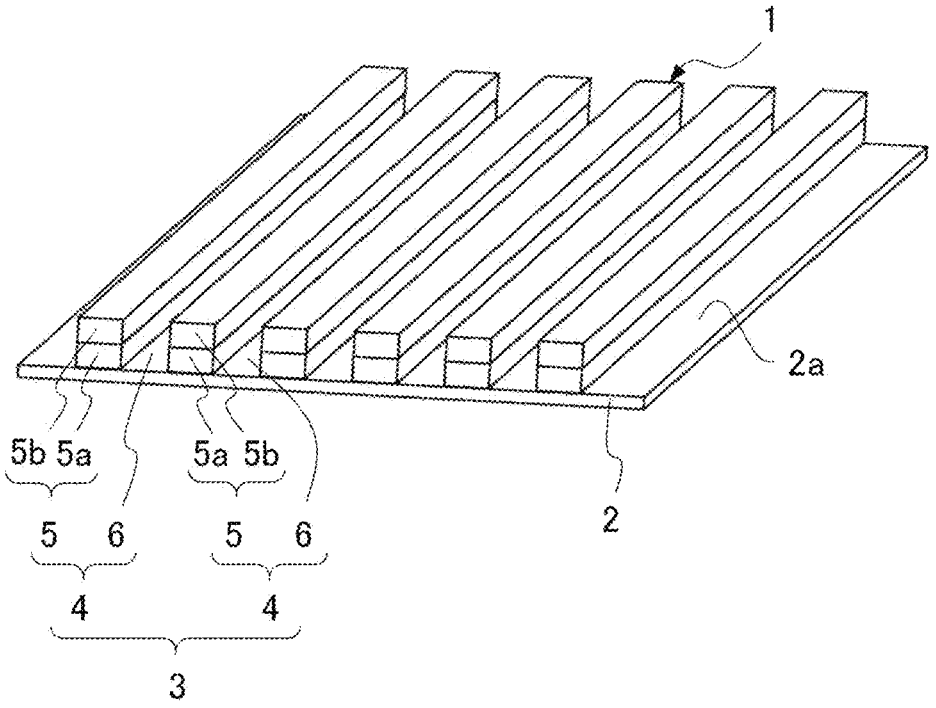
FIG. 3 is a schematic perspective view that illustrates another embodiment of the uneven sheet member according to one embodiment of the present invention.
Figure 4:
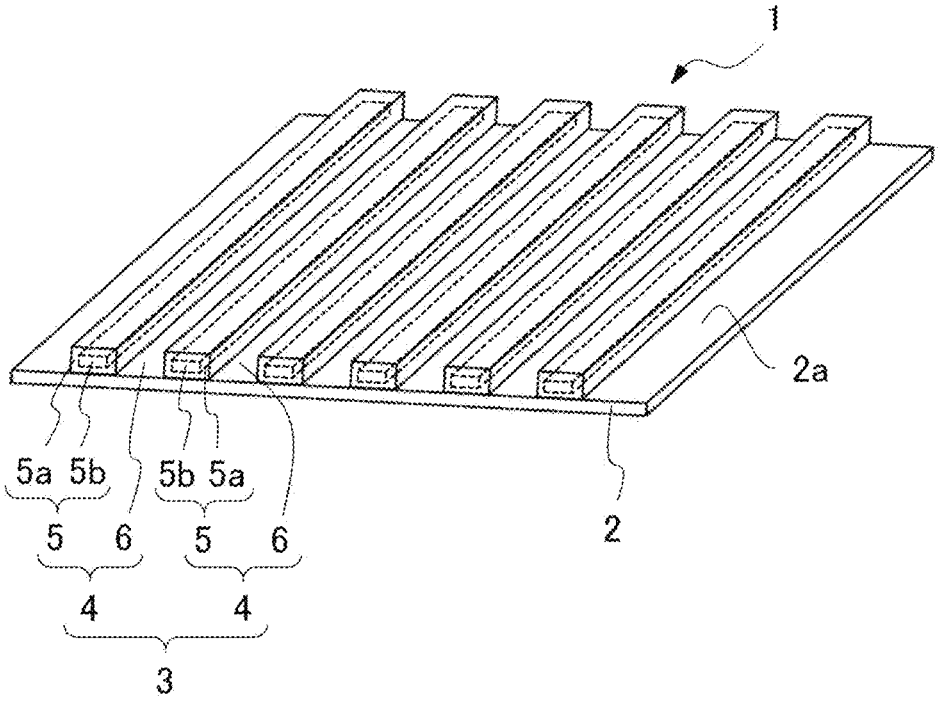
FIG. 4 is a schematic perspective view that illustrates yet another embodiment of the uneven sheet member according to one embodiment of the present invention.

The protruding parts 5 may each be constituted by a single structural body as illustrated in FIGS. 1 and 2, or by a composite structural body composed of a base portion 5*a* which protrudes to an appropriate height, and a weight portion 5*b* which is supported on the upper end of the base portion 5*a* and has a larger mass than the base portion 5*a*, as illustrated in FIG. 3. Further, as illustrated in FIG. 4, the protruding parts 5 may each be constituted a composite structural body in which the weight portion 5*b* is embedded in the base portion 5*a*. In such a composite structural body, the local rigidity and mass of each protruding part 5 are increased, as a result of which the sound insulation performance of the uneven sheet member 1 in a low-frequency band is improved. Moreover, the protruding parts 5 may each be a porous body that contains pores (gas such as air) within a range that does not cause deterioration of the sound insulation performance.

The material constituting the base portion 5*a* may be the below-described material of the protruding parts.

The material constituting the weight portion 5*b* may be selected as appropriate taking into consideration the mass, the cost, and the like, and examples thereof include: metals, such as aluminum, stainless steel, iron, tungsten, gold, silver, copper, lead, zinc, and brass, and alloys thereof; inorganic glasses, such as soda glass, quartz glass, and lead glass; and composites that contain, for example, powder of any of the above-exemplified metals and alloys or any of the above-exemplified inorganic glasses in the resin material of the above-described base portions 5*a*. The material, mass, and specific gravity of the weight portion 5*b* may be determined such that the sound-insulating structural body 7 conform to a desired sound insulation frequency range.

The protruding parts 5, as appropriate, may have a discontinuous structure that is interrupted in the middle in the longitudinal direction. The plural protruding parts 5 are arranged in parallel to one another, however, without being limited to a parallel arrangement, the protruding parts 5 may each be arranged at an angle as appropriate, as long as they do not overlap with each other.

Figure 5:
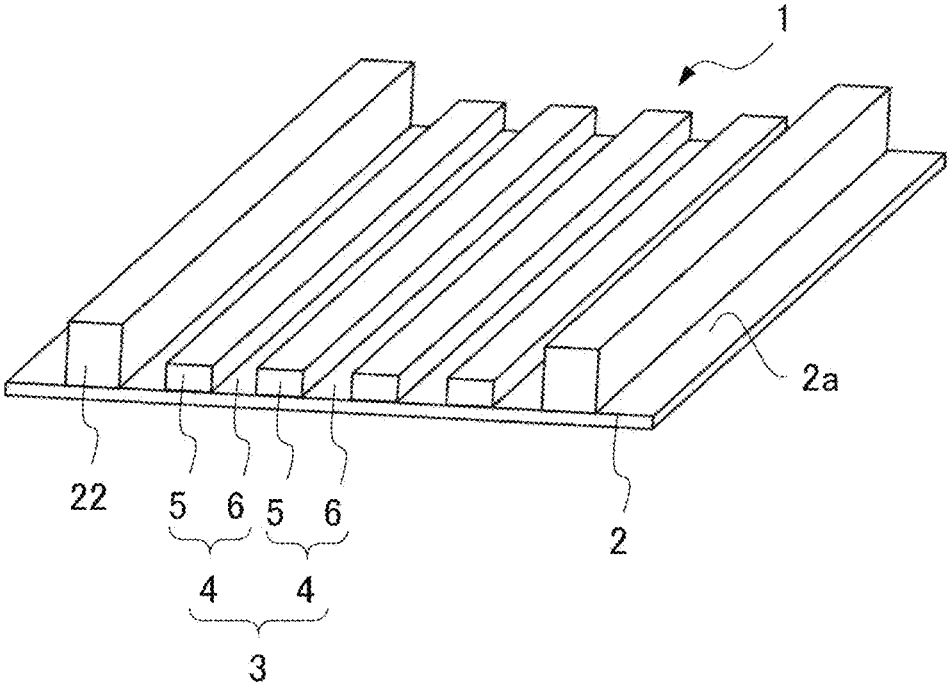
FIG. 5 is a schematic perspective view that illustrates yet another embodiment of the uneven sheet member according to one embodiment of the present invention.

The uneven structure 3 may also be configured such that, as illustrated in FIG. 5, rib-like projections 22 are provided on the surface 2*a* of the sheet section 2 of the uneven sheet member 1. The rib-like projections 22 are arranged in a pair in the respective marginal parts on the opposing short sides of the sheet section 2, sandwiching the protruding parts 5. The rib-like projections 22 are both provided in a rectangular plate shape extending in parallel (including a case of extending in substantially parallel) to the protruding parts 5, with the upper surfaces of the rib-like projections 22 being parallel (including a case of being substantially parallel) to the surface 2*a*. The rib-like projections 22 have a greater maximum height than that of the protruding parts 5 with respect to the normal direction of the sheet section 2. For example, when the sheet section 2 is produced in a so-called roll-to-roll manner where the uneven structure 3 is cut out from an elongated sheet material provided on one surface of the sheet section 2, even if the uneven sheet member 1 is wound in the form of a sheet or a plurality thereof are stacked on top of each other, the rib-like projections 22 are allowed to function as spacers by aligning the axial direction (longitudinal direction) of the rib-like projections 22 with the longitudinal direction of the sheet material (sheet flow direction); therefore, the protruding parts 5 are prevented from coming into contact with the back side of the stacked sheet section 2. By providing the rib-like projections 22, troubles in production such as deformation, variation, cracking, detachment, and breakage of the protruding parts 5 are made unlikely to occur, and it is thus made easy to produce and store the uneven sheet member 1 in a so-called roll-to-roll manner.

Figure 7:
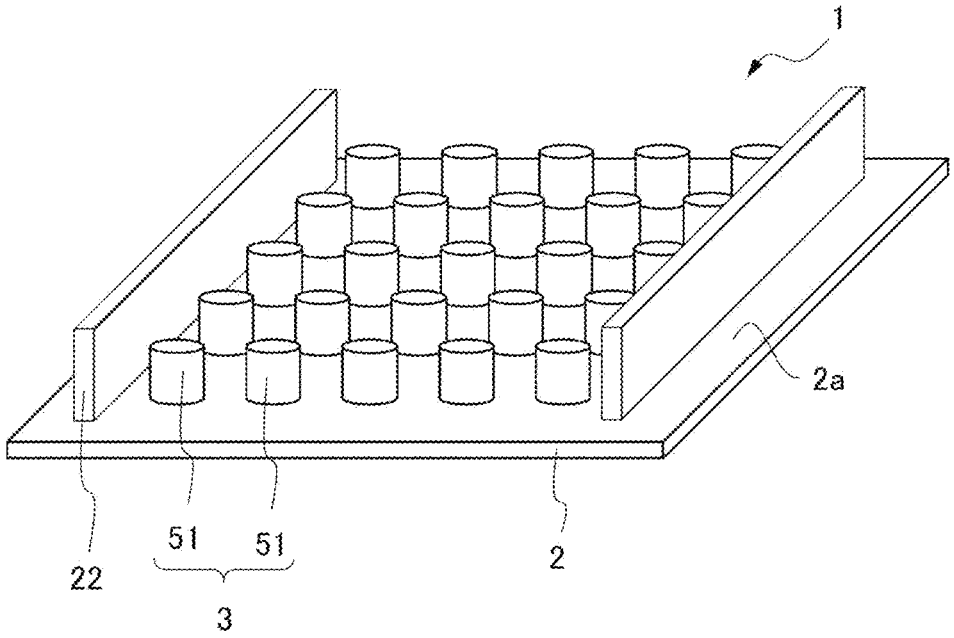
FIG. 7 is a schematic perspective view that illustrates yet another embodiment of the uneven sheet member according to one embodiment of the present invention.
Figure 8:
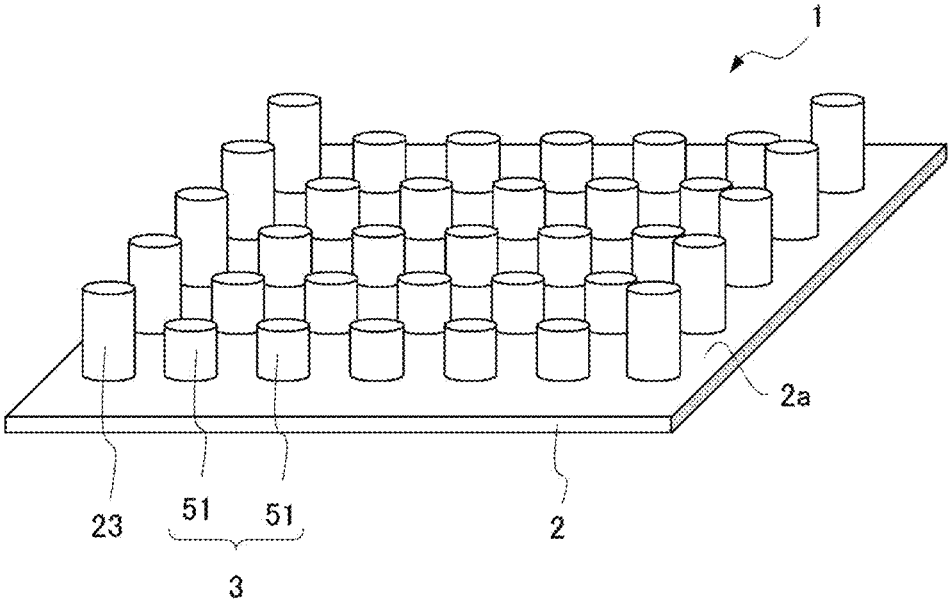
FIG. 8 is a schematic perspective view that illustrates yet another embodiment of the uneven sheet member according to one embodiment of the present invention.

As the uneven sheet member 1 constituting the sound-insulating structural body 7, a sheet member having the linear uneven structure 3 as illustrated in any of FIGS. 1 to 5, or a sheet member having the uneven structure 3 composed of dot-like protruding parts as illustrated in FIGS. 6 to 8 can be used.

The uneven sheet member 1 illustrated in FIGS. 6 to 8 has an uneven structure 3 in which, on the surface 2*a* of one side of the sheet section 2, plural dot-like protruding parts (also referred to as "projections" in the description of FIGS. 6 to 8) 51 are arranged both lengthwise and crosswise at prescribed intervals as uneven unit shapes 4.

The projections 51 constituting the uneven structure 3 provide local rigidity and mass (preferably in a periodic manner) and exert a function of exciting a vibration mode corresponding to the distance between the projections 51 on the sheet section 2, so that a high sound insulation performance exceeding the law of mass can be obtained when a sound wave having a specific frequency is input thereto.

The projections 51 may each be constituted by a single structural body as illustrated in FIG. 6, or may each be constituted by a composite structural body including a weight portion (not illustrated) as long as arrangement of the weight portion does not cause a problem for molding. The projections 51 may each be a porous body as well.

As illustrated in FIG. 7, a configuration in which the rib-like projections 22 are provided on the surface 2*a* of the sheet section 2 of the uneven sheet member 1 may be adopted as well. The rib-like projections 22 are not limited to be configured in a rectangular plate shape. For example, as illustrated in FIG. 8, plural rib-like projections 23 each molded in a substantially cylindrical shape may be arranged at intervals in the marginal parts on both sides of a first direction such that the projections 23 form rows along a second direction in each marginal part. By adopting this configuration, not only the same actions and effects as those provided by the rib-like projections 22 having a rectangular plate shape as illustrated in FIG. 7 are obtained, but also the flowability (flexibility) of the uneven sheet member 1 is improved by the plural rib-like projections 23 arranged at intervals. Therefore, even when an attachment surface has a more complex shape, the stretchable and flexible sheet section 2 can conform to the shape of such a surface.

The uneven structure 3 has the projections 51 as uneven unit shapes, and the projections 51 are repeatedly arrayed in at least two different directions along the surface 2*a* of the sheet section 2 on the side of the uneven structure 3. In FIGS. 6 to 8, the projections 51 are arrayed along the orthogonal sides of the substrate 2 having a rectangular shape in a plan view. The projections 51 generally have, for example, a cylindrical shape, a prismatic shape, a conical shape, a truncated cone shape, a pyramid shape, a truncated pyramid shape, a hemispherical shape, or an ellipsoidal shape, and any of these shapes may be selected as appropriate in accordance with the intended use from the standpoint of, for example, sound insulation performance, production cost, and ease of handling.

In the above-described uneven structure 3, the ratio of the area of the projections 51 with respect to the area of the surface 2*a* of the sheet section 2 on the side of the uneven structure 3 is preferably 5 to 80% (5% or higher but 80% or lower), more preferably 5.5 to 70% (5.5% or higher but 70% or lower), still more preferably 6 to 60% (6% or higher but 60% or lower). When the above-described ratio is in this range, sound insulation performance attributed to vibration of the sheet section 2 is exerted, so that the sound insulation performance is dramatically improved. The "area of the projections 51" means the area of the cross-sections of the projections 51 parallel to the sheet surface at positions where the projections 51 are connected with the surface 2*a* of the sheet section 2.

In the above-described uneven structure 3, it is preferred that the mass per projection 51 (per unit) be 20 mg or more and 900 mg or less, and that the ratio of the area of the projections 51 with respect to the area of the surface 2*a* (filling rate) be in the above-described range. In this case, the projections 51 play a role in providing local (preferably local and periodic) rigidity and mass for the sheet section 2 to vibrate in a mode effective for sound insulation when a sound wave is input thereto from a noise source.

As described above, the projections 51 have a mass per unit shape of preferably 20 mg or more and 900 mg or less, more preferably 22 mg or more and 700 mg or less, still more preferably 24 mg or more and 600 mg or less, particularly preferably 25 mg or more and 500 mg or less. When the mass of the projections 51 per unit shape is 20 mg or more and 900 mg or less, the local (preferably local and periodic) rigidity and mass provided by the projections 51 excite a vibration mode effective for sound insulation at a specific frequency on the sheet section 2, so that the sound insulation performance is dramatically improved.

From the standpoint of inducing a vibration mode effective for sound insulation on the sheet section, the density of the projections 51 is preferably not less than 100 kg/m$^3$, more preferably not less than 1,000 kg/m$^3$. From the standpoint of weight reduction, the density of the projections 51 is preferably 10,000 kg/m$^3$ or less, usually 8,000 kg/m$^3$ or less, and it may be 5,000 kg/m$^3$ or less, or 3,000 kg/m$^3$ or less.

The projections 51 have a maximum width at a cross-section parallel to the surface 2*a* (hereinafter, simply referred to as "maximum width"), i.e. diameter when the projections 51 have a cylindrical shape or maximum cross width when the projections 51 have a prismatic shape, of preferably 0.5 mm or more and 50 mm or less, more preferably 1.0 mm or more and 30 mm or less, still more preferably 1.5 mm or more and 20 mm or less, particularly preferably 2.0 mm or more and 10 mm or less. When the maximum width of the projections 51 is 0.5 mm or more, excellent sound insulation performance is obtained, while when the maximum width of the projections 51 is 50 mm or less, excellent moldability and excellent ease of handling are obtained.

Further, the projections 51 have a height (maximum height) of preferably not less than 0.1 mm, not less than 0.5 mm, but 50 mm or less, more preferably 0.7 mm or more and 30 mm or less, still more preferably 0.9 mm or more and 20 mm or less, particularly preferably 1.2 mm or more and 10 mm or less. When the height of the projections 51 is 0.5 mm or more, excellent sound insulation performance is obtained, while when the height of the projections 51 is 50 mm or less, excellent moldability and excellent ease of handling are obtained.

Moreover, the interval of the projections 51 is preferably 1 mm or more and 100 mm or less, more preferably 1.4 mm or more and 80 mm or less, still more preferably 1.8 mm or more and 60 mm or less, particularly preferably 2 mm or more and 50 mm or less. When the interval of the uneven unit shapes is 1 mm or larger, excellent moldability is obtained, while when the interval of the uneven unit shapes is 100 mm or smaller, excellent sound insulation performance is obtained. The "interval of the uneven unit shapes" means the distance (arrangement pitch) between the centers of an uneven unit shape and its adjacent uneven unit shape that are connected by a straight line.

The value of the mass per projection 51 with respect to the thickness of the sheet section 2 (mass per projection (mg/projection)/thickness of sheet section 2 (μm)) is preferably in a range of 0.4 or more and 4 or less. When the projections 51 have a certain weight with respect to the thickness of the substrate 2, the projections 51 can effectively provide local (preferably local and periodic) rigidity and mass, so that the sound insulation effect can be enhanced.

The number of the projections 51 per unit area (number ratio) is preferably plural, specifically 40/m$^2$ or more and 1,000,000/m$^2$ or less, more preferably 100/m$^2$ or more and 500,000/m$^2$ or less, still more preferably 300/m$^2$ or more and 100,000/m$^2$ or less, particularly preferably 500/m$^2$ or more and 30,000/m$^2$ or less, or 1,000/m$^2$ or more and 10,000/m$^2$ or less. The presence of the projections 51 in a certain number allows effective sound insulation.

The type of the material used for the formation of the protruding parts 5 is not particularly limited, and the material is preferably one which has a rubber elasticity and a measurable dynamic viscoelasticity, such as a resin or an elastomer. It is noted here that, although the conditions of the material of the sheet section 2 are described above, the below-described material used for the formation of the protruding parts 5 may be applied as well.

Examples of the resin include thermosetting or photocurable resins and thermoplastic resins, and examples of the elastomer include thermosetting or photocurable elastomers and thermoplastic elastomers. Thereamong, a photocurable resin or a photocurable elastomer is preferred, and a photocurable resin is particularly preferred since it has favorable shape transferability and exhibits an excellent sound insulating function. When a thermosetting or thermoplastic resin, or a thermosetting or thermoplastic elastomer is used as the material of the protruding parts 5, thermal curing reaction is required at the time of molding the protruding parts 5; therefore, there is a strong tendency for air bubbles to be generated in the resulting molded protruding parts 5. The generation of air bubbles cause deterioration of the sound insulation performance. Meanwhile, when a photocurable resin or a photocurable elastomer is used as the material of the protruding parts 5, the sound insulation performance is unlikely to be deteriorated since the above-described problem of air bubbles does not occur.

These resins and elastomers may be used singly, or two or more thereof may be used in any combination at any ratio; however, from the standpoint of enabling to control the properties such as storage elastic modulus and tensile elongation at break, it is preferred to use a combination of two or more of these materials.

Examples of the resin used for the formation of the protruding parts 5 include: thermosetting resins, such as unsaturated polyester resins, phenolic resins, epoxy resins, urethane resins, and rosin-modified maleic acid resins; photocurable resins, for example, homopolymers and copolymers of monomers such as epoxy (meth)acrylate, urethane (meth)acrylate, polyester (meth)acrylate, polyether (meth) acrylate, and modified products thereof; homopolymers and copolymers of vinyl monomers such as vinyl acetate, vinyl chloride, vinyl alcohol, vinyl butyral, and vinylpyrrolidone; and thermoplastic resins, such as saturated polyester resins, polycarbonate resins, polyamide resins, polyolefin resins, polyarylate resins, polysulfone resins, and polyphenylene ether resins. Thereamong, urethane (meth)acrylate, polyester (meth)acrylate, or polyether (meth)acrylate, which yields a cured product having a low elastic modulus, is preferred, and urethane (meth)acrylate is particularly preferred.

Examples of the elastomer used for the formation of the protruding parts 5 include: thermosetting elastomers, for example, thermosetting resin-based elastomers such as vulcanized rubbers, including chemically-crosslinked natural or synthetic rubber, urethane rubber, silicone rubber, fluorine rubber, and acrylic rubber; thermoplastic elastomers, such as olefin-based thermoplastic elastomers, styrene-based thermoplastic elastomers, polyvinyl chloride-based thermoplastic elastomers, urethane-based thermoplastic elastomers, ester-based thermoplastic elastomers, amide-based thermoplastic elastomers, silicone rubber-based thermoplastic elastomers, and acrylic thermoplastic elastomers; photocurable elastomers, such as acrylic photocurable elastomers, silicone-based photocurable elastomers, and epoxy-based photocurable elastomers; silicone-based thermosetting elastomers; acrylic thermosetting elastomers; and epoxy-based thermosetting elastomers. Thereamong, a silicone-based thermosetting elastomer or an acrylic-based thermosetting elastomer, which is a thermosetting elastomer, or an acrylic photocurable elastomer or a silicone-based photocurable elastomer, which is a photocurable elastomer, is preferred.

A "photocurable resin" is a resin polymerized by photoirradiation. Examples thereof include photo-radical polymerizable resins and photo-cationic polymerizable resins. Thereamong, a photo-radical polymerizable resin is preferred. The photo-radical polymerizable resin preferably has at least one or more (meth)acryloyl groups in the molecule. A photo-radical polymerizable elastomer having one or more (meth)acryloyl groups in the molecule is not particularly limited; however, from the standpoint of the elastic modulus of its cured product, examples thereof include methyl (meth)acrylate, ethyl (meth)acrylate, n-propyl (meth)acrylate, i-propyl (meth)acrylate, n-butyl (meth)acrylate, i-butyl (meth)acrylate, t-butyl (meth)acrylate, 2-methylbutyl (meth)acrylate, n-pentyl (meth)acrylate, n-hexyl (meth)acrylate, n-heptyl (meth)acrylate, 2-methylhexyl (meth)acrylate, 2-ethylhexyl (meth)acrylate, 2-butylhexyl (meth)acrylate, isooctyl (meth)acrylate, isopentyl (meth) acrylate, isononyl (meth)acrylate, isodecyl (meth)acrylate, isobornyl (meth)acrylate, cyclohexyl (meth)acrylate, benzyl (meth)acrylate, phenoxy (meth)acrylate, n-nonyl (meth) acrylate, n-decyl (meth)acrylate, lauryl (meth)acrylate, hexadecyl (meth)acrylate, stearyl (meth)acrylate, morpholin-4-yl (meth)acrylate, and urethane (meth)acrylate. Thereamong, urethane (meth)acrylate is preferred from the standpoint of the elastic modulus of its cured product.

Further, a compound having an ethylenically unsaturated bond may be contained as the resin used for the formation of the protruding parts 5. Examples of the compound having an ethylenically unsaturated bond include: aromatic vinyl monomers, such as styrene, α-methylstyrene, α-chlorostyrene, vinyltoluene, and divinylbenzene; vinyl ester monomers, such as vinyl acetate, vinyl butyrate, N-vinylformamide, N-vinylacetamide, N-vinyl-2-pyrrolidone, N-vinylcaprolactam, and divinyl adipate; vinyl ethers, such as ethyl vinyl ether and phenyl vinyl ether; allyl compounds, such as diallyl phthalate, trimethylolpropane diallyl ether, and allyl glycidyl ether; (meth)acrylamides, such as (meth) acrylamide, N,N-dimethyl (meth)acrylamide, N-methylol (meth)acrylamide, N-methoxymethyl (meth)acrylamide, N-butoxymethyl (meth)acrylamide, N-t-butyl(meth)acrylamide, (meth)acryloyl morpholine, and methylene-bis (meth)acrylamide; mono(meth)acrylates, such as (meth) acrylic acid, methyl (meth)acrylate, ethyl (meth)acrylate, propyl (meth)acrylate, n-butyl (meth)acrylate, i-butyl (meth) acrylate, t-butyl (meth)acrylate, hexyl (meth)acrylate, 2-ethylhexyl (meth)acrylate, lauryl (meth)acrylate, stearyl (meth) acrylate, tetrahydrofurfuryl (meth)acrylate, morpholyl (meth)acrylate, 2-hydroxyethyl (meth)acrylate, 2-hydroxypropyl (meth)acrylate, 4-hydroxybutyl (meth)acrylate, glycidyl (meth)acrylate, dimethylaminoethyl (meth)acrylate, diethylaminoethyl (meth)acrylate, benzyl (meth)acrylate, cyclohexyl (meth)acrylate, phenoxyethyl (meth)acrylate, tricyclodecane (meth)acrylate, dicyclopentenyl (meth)acrylate, allyl (meth)acrylate, 2-ethoxyethyl (meth)acrylate, isobornyl (meth)acrylate, and phenyl (meth)acrylate; polyfunctional(meth)acrylates, such as ethylene glycol di(meth)acrylate, diethylene glycol di(meth)acrylate, triethylene glycol di(meth)acrylate, tetraethylene glycol di(meth) acrylate, polyethylene glycol di(meth)acrylate (number of repeating units: 5 to 14), propylene glycol di(meth)acrylate, dipropylene glycol di(meth)acrylate, tripropylene glycol di(meth)acrylate, tetrapropylene glycol di(meth)acrylate, polypropylene glycol di(meth)acrylate (number of repeating units: 5 to 14), 1,3-butylene glycol di(meth)acrylate, 1,4-butanediol di(meth)acrylate, polybutylene glycol di(meth) acrylate (number of repeating units: 3 to 16), poly(1-methylbutylene glycol) di(meth)acrylate (number of repeating units: 5 to 20), 1,6-hexanediol di(meth)acrylate, 1,9-nonanediol di(meth)acrylate, neopentyl glycol di(meth)acrylate, neopentyl glycol hydroxypivalate di(meth)acrylate, dicyclopentanediol di(meth)acrylate, di(meth)acrylic acid esters of caprolactone adducts of neopentyl glycol hydroxypivalate (n+m=2 to 5), di(meth)acrylic acid esters of γ-butyrolactone adducts of neopentyl glycol hydroxypivalate (n+m=2 to 5), di(meth)acrylic acid esters of caprolactone adducts of neopentyl glycol (n+m=2 to 5), di(meth)acrylic acid esters of caprolactone adducts of butylene glycol (n+m=2 to 5), di(meth)acrylic acid esters of caprolactone adducts of cyclohexane dimethanol (n+m=2 to 5), di(meth)acrylic acid esters of caprolactone adducts of dicyclopentanediol (n+m=2 to 5), di(meth)acrylic acid esters of caprolactone adducts of bisphenol A (n+m=2 to 5), di(meth)acrylic acid esters of caprolactone adducts of bisphenol F (n+m=2 to 5), di(meth) acrylic acid esters of bisphenol A ethylene oxide adducts (p=1 to 7), di(meth)acrylic acid esters of bisphenol A propylene oxide adducts (p=1 to 7), di(meth)acrylic acid esters of bisphenol F ethylene oxide adducts (p=1 to 7), di(meth)acrylic acid esters of bisphenol F propylene oxide adducts (p=1 to 7), trimethylolpropane tri(meth)acrylate, tri(meth)acrylic acid esters of trimethylolpropane ethylene oxide adducts (p=1 to 5), a tri(meth)acrylic acid esters of trimethylolpropane propylene oxide adducts (p=1 to 5), glycerol tri(meth)acrylate, tri(meth)acrylic acid esters of glycerol ethylene oxide adducts (p=1 to 5), ditrimethylolpropane tetra(meth)acrylate, tetra(meth)acrylic acid esters of ditrimethylolpropane ethylene oxide adducts (p=1 to 5), pentaerythritol tri(meth)acrylate, pentaerythritol tetra(meth) acrylate, tri(meth)acrylic acid esters of pentaerythritol ethylene oxide adducts (p=1 to 5), tetra(meth)acrylic acid esters of pentaerythritol ethylene oxide adducts (p=1 to 15), tri (meth)acrylic acid esters of pentaerythritol propylene oxide adducts (p=1 to 5), tetra(meth)acrylic acid esters of pentaerythritol propylene oxide adducts (p=1 to 15), penta (meth)acrylic acid esters of dipentaerythritol ethylene oxide adducts (p=1 to 5), hexa(meth)acrylic acid esters of dipentaerythritol ethylene oxide adducts (p=1 to 15), poly(meth) acrylates such as N,N',N"-tris((meth)acryloxy poly(p=1 to 4) (ethoxy)ethyl)isocyanurate, tri(meth)acrylic acid esters of pentaerythritol caprolactone (4 to 8 moles) adducts, tetra (meth)acrylic acid esters of pentaerythritol caprolactone (4 to 8 moles) adducts, dipentaerythritol penta(meth)acrylate, dipentaerythritol hexa(meth)acrylate, penta(meth)acrylic acid esters of dipentaerythritol caprolactone (4 to 12 moles) adducts, hexa(meth)acrylic acid esters of dipentaerythritol caprolactone (4 to 12 moles) adducts, N,N',N"-tris(acryloxyethyl)isocyanurate, N,N'-bis(acryloxyethyl)-N"-hydroxyethyl isocyanurate, isocyanuric acid ethylene oxide modified (meth)acrylate, isocyanuric acid propylene oxide modified (meth)acrylate, and isocyanuric acid ethylene oxide-propylene oxide modified (meth)acrylate; and epoxy poly(meth) acrylates obtained by an addition reaction between a polyepoxy compound having plural epoxy groups in the molecule and a (meth)acrylic acid, such as bisphenol A glycidyl ether, bisphenol F glycidyl ether, a phenol novolac-type epoxy resin, a cresol novolac-type epoxy resin, pentaerythritol polyglycidyl ether, trimethylolpropane triglycidyl ether, and triglycidyl tris(2-hydroxyethyl) isocyanurate. Thereamong, phenoxyethyl acrylate, benzyl acrylate, 2-ethylhexyl (meth)acrylate, or methoxypolyethylene glycol acrylate, which yields a cured product having a low elastic modulus, is preferred, and 2-ethylhexyl(meth) acrylate or methoxypolyethylene glycol acrylate is more preferred. These compounds may be used singly, or in combination of two or more thereof as a mixture.

The content of the resin and/or elastomer used for the formation of the protruding parts 5 is not particularly limited and can be adjusted as appropriate from the standpoint of, for example, sound insulation performance, production cost, other functions. Taking the mass of materials constituting the protruding parts 5 as 100% by mass, the above-described content is, for example, usually not less than 70% by mass, preferably not less than 80% by mass. Further, the content may be 100% by mass, and it is preferably 99% by mass or less.

When the protruding parts 5 are formed including a photocurable resin or elastomer, from the standpoint of, for example, improving the moldability and the mechanical strength and reducing the production cost, a photopolymerization initiator is preferably incorporated, and examples thereof include benzoin-based, acetophenone-based, thioxanthone-based, phosphine oxide-based, and peroxide-based photopolymerization initiators. Specific examples of the photopolymerization initiator include benzophenone, 4,4-bis(diethylamino)benzophenone, 2,4,6-trimethylbenzophene, methyl ortho-benzoyl benzoate, 4-phenylbenzophenone, t-butylanthraquinone, 2-ethylanthraquinone, diethoxyacetophenone, 2-hydroxy-2-methyl-1-phenylpropan-1-one, 2-hydroxy-1-{4-[4-(2-hydroxy-2-methyl-propionyl)-benzyl]phenyl}-2-methyl-propan-1-one, benzyl dimethyl ketal, 1-hydroxycyclohexyl-phenyl ketone, benzoin methyl ether, benzoin ethyl ether, benzoin isopropyl ether, benzoin isobutyl ether, 2-methyl-[4-(methylthio)phenyl]-2-morpholino-1-propanone, 2-benzyl-2-dimethylamino-1-(4-morpholinophenyl)-butanone-1, diethylthioxanthone, isopropylthioxanthone, 2,4,6-trimethylbenzoyldiphenyl phosphine oxide, bis(2,6-dimethoxybenzoyl)-2,4,4-trimethylpentyl phosphine oxide, bis(2,4,6-trimethylbenzoyl)-phenyl phosphine oxide, and methyl benzoylformate. These photopolymerization initiators may be used singly, or two or more thereof may be used in any combination at any ratio.

The content of the photopolymerization initiator(s) in the resin used for the formation of the protruding parts 5 is not particularly limited; however, from the standpoint of improving the mechanical strength and maintaining an appropriate reaction rate, it is usually not less than 0.1% by mass, preferably not less than 0.3% by mass, more preferably not less than 0.5% by mass, but usually 3% by mass or less, preferably 2% by mass or less, taking the mass of materials constituting the uneven structure 3 as 100% by mass, The resin used for the formation of the protruding parts 5 may also contain, for example, particles, plates, and/or spheres so as to improve the sound insulation performance, other functions, and the like. These materials are not particularly limited, and examples thereof include metallic materials, inorganic materials, and organic materials. From the standpoint of improving the mechanical strength and reducing the material cost, the protruding parts 5 may contain inorganic fine particles. Examples thereof include transparent inorganic fine particles of silicon oxide, aluminum oxide, titanium oxide, soda glass, diamond, and the like. In addition to these inorganic fine particles, for example, particles of a resin such as an acrylic resin, a styrene resin, a silicone resin, a melamine resin, an epoxy resin, or a copolymer of these resins can be used as fine particles.

The resin used for the formation of the protruding parts 5 may also contain, as other components, various additives such as a flame retardant, an antioxidant, a plasticizer, an antifoaming agent, and a mold release agent as long as the sound insulation performance is not deteriorated, and these additives may be used singly, or in combination of two or more thereof.

The flame retardant is an additive that is incorporated to make flammable materials unlikely to burn or ignite. Specific examples thereof include, but not particularly limited to: bromine compounds, such as pentabromodiphenyl ether, octabromodiphenyl ether, decabromodiphenyl ether, tetrabromobisphenol A, hexabromocyclododecane, and hexabromobenzene; phosphorus compounds such as triphenyl phosphate; chlorine compounds such as chlorinated paraffin; antimony compounds such as antimony trioxide; metal hydroxides such as aluminum hydroxide; nitrogen compounds such as melamine cyanurate; and boron compounds such as sodium borate.

The antioxidant is an additive that is incorporated to inhibit oxidative degradation. Specific examples thereof include, but not particularly limited to: phenolic antioxidants, sulfur-based antioxidants, and phosphorus-based antioxidants.

The plasticizer is an additive that is incorporated to improve flexibility and weather resistance. Specific examples thereof include, but not particularly limited to: phthalic acid esters, adipic acid esters, trimellitic acid esters, polyesters, phosphoric acid esters, citric acid esters, sebacic acid esters, azelaic acid esters, maleic acid esters, silicone oils, mineral oils, vegetable oils, and modified products thereof.

(Method of Molding Uneven Sheet Member)

A method of molding the uneven sheet member 1 is not particularly limited, and any commonly known sheet molding method can be employed. In the case of using a thermosetting or thermoplastic resin or elastomer, for example, a melt molding method such as press molding, extrusion molding, or injection molding may be employed and, in this case, the molding conditions such as the temperature and pressure at which melt molding is performed can be modified as appropriate in accordance with the type of the material used. In the case of using a photocurable resin or elastomer, for example, the resin or the like can be injected into an active energy ray-transmitting plate-shaped mold and photo-cured by irradiation with an active energy ray.

The active energy ray, which is a specific beam of light used for curing a photocurable resin or the like, may be any active energy ray that cures the photocurable resin or the like to be used, and examples thereof include ultraviolet rays and electron beams. The amount of the active energy ray to be irradiated may be any amount that cures the photocurable resin or the like to be used and, taking into consideration the types and the amounts of monomers and polymerization initiator, for example, an ultraviolet ray having a wavelength of 200 to 400 nm is usually irradiated in a range of 0.1 to 200 J. As a light source of the active energy ray, for example, a chemical lamp, a xenon lamp, a low-pressure mercury lamp, a high-pressure mercury lamp, or a metal halide lamp is used. The irradiation of the active energy ray may be performed in a single step; however, in order to obtain a photo-cured resin sheet having favorable surface properties, it is preferred to perform the irradiation of the active energy ray in plural steps, i.e. at least two steps. When a photocurable resin is used, a curing accelerator may be incorporated as well.

Further, a method of molding the protruding parts 5 on the sheet section 2 is not particularly limited, and a method of simultaneously molding the sheet section 2 and the protruding parts 5 using a mold having cavities of an uneven structure, or a method of molding the sheet section 2 and the protruding parts 5 by integration may be employed. A method of molding the sheet section 2 and the protruding parts 5 by integration will now be described in detail; however, the method of molding the protruding parts 5 on the sheet section 2 is not limited thereto.

A method of integrating the sheet section 2 and the protruding parts 5 is not particularly limited, and either a method forming the protruding parts 5 on the sheet section 2 or a method of adhering the protruding parts 5 and the sheet section 2 after they are molded may be employed. In the case of the latter method of adhering, it is preferred to use an adhesive, and the type of the adhesive is not limited as long as it can adhere the protruding parts 5 and the sheet section 2.

Figure 11:
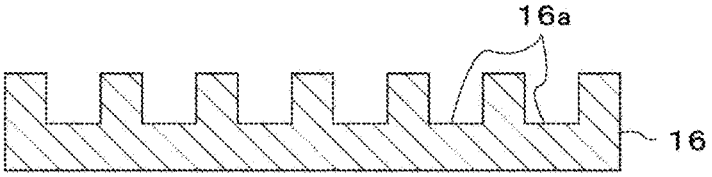
FIG. 11 is a drawing that schematically illustrates a cut-end surface of an exemplary mold used for the production of an uneven sheet member.

Next, one example of a mode of molding the uneven sheet member 1 using a thermosetting resin will be described. FIG. 11 illustrates a schematic cut-end surface of an exemplary mold used for molding the uneven sheet member 1. On the upper surface of an illustrated mold 16, an uneven section corresponding to the outer shape of the uneven structure 3 of the uneven sheet member 1 is formed, i.e. plural cavities (recessed grooves) 16*a* are formed by depressing the surface in the shape of grooves corresponding to the outer shape of the protruding parts 5.

The uneven sheet member 1 can be molded using this mold 16 by the following procedure. First, the mold 16 is set with the side on which the cavities 16*a* are formed facing up, and a photocurable resin is allowed to flow into and fill the cavities 16*a*, after which the sheet section 2, which is made of a material transmitting a specific beam of light such as an ultraviolet ray or an electron beam that cures the photocurable resin, is disposed on the mold 16. Subsequently, in a condition where the sheet section 2 is press-bonded to the upper surface of the mold 16, the specific beam of light is irradiated from above and transmitted through the sheet section 2 to cure the photocurable resin inside the cavities 16*a* and thereby immobilize the photocurable resin on the surface of the sheet section 2. Thereafter, once the photocurable resin is cured, the sheet section 2 on which the protruding parts 5 have been immobilized is peeled off from the mold 16 as illustrated in FIG. 12, whereby the uneven sheet member 1 in which the uneven structure 3 is formed on the surface of the sheet section 2 can be obtained.

Figure 13:
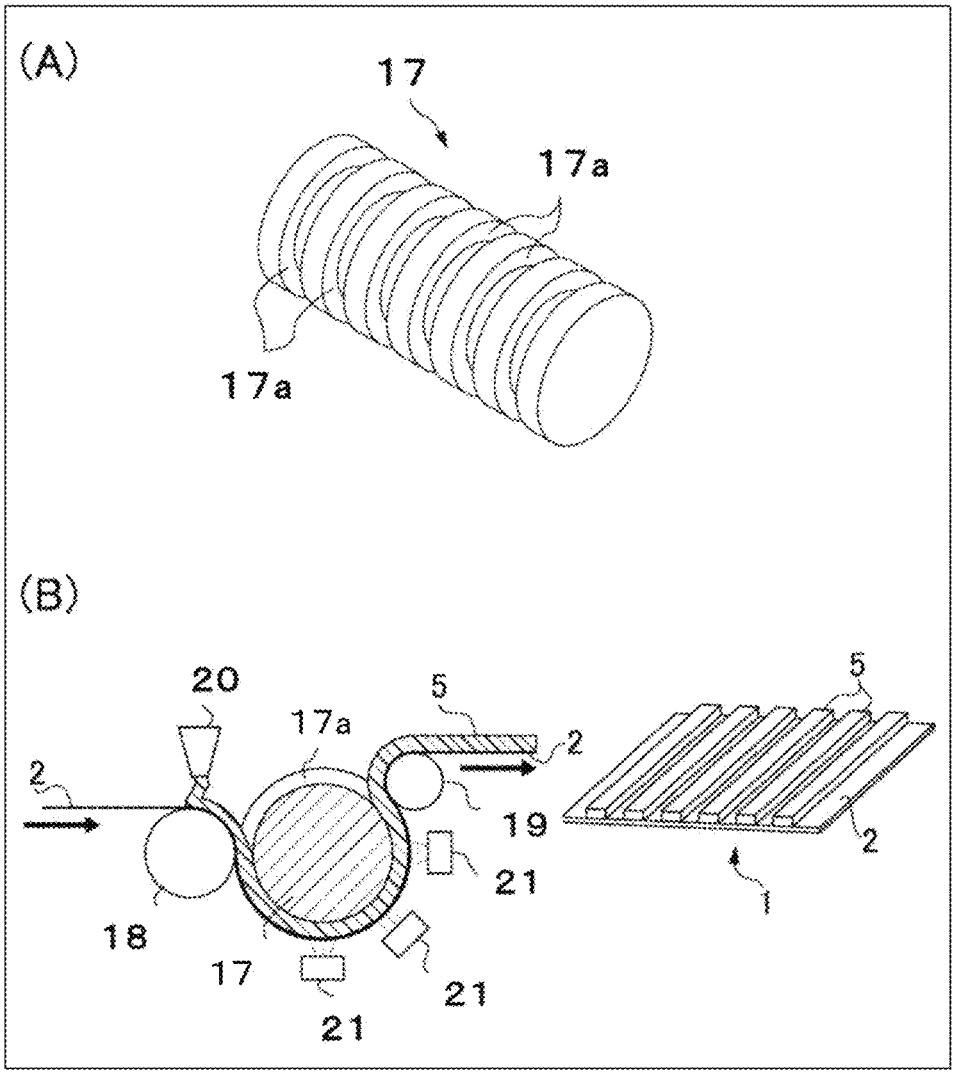
FIG. 13 Panel (A) of FIG. 13 is a schematic external view of a cylindrical mold, and Panel (B) of FIG. 13 is a drawing for describing the steps of producing an uneven sheet member using this mold.

FIG. 13 illustrates a mode of molding the uneven sheet member 1 in a so-called roll-to-roll manner using a photocurable resin in the same manner along with the elongated sheet-like sheet section 2 made of a material transmitting a specific beam of light that cures the photocurable resin. As illustrated in Panel (A) of FIG. 13, for molding in this case, a cylindrical roll-like mold 17, on which plural cavities 17*a* are formed on the peripheral surface along the circumferential direction by depressing the surface in the shape of grooves corresponding to the outer shape of the protruding parts 5, is used. The elongated sheet-like sheet section 2 is delivered from a sheet supply means (not illustrate) which supports the sheet section 2 wound into a raw sheet roll and delivers out the sheet section 2 and, as illustrated in Panel (B) of FIG. 13, not only the sheet section 2 is press-bonded and wound on the peripheral surface of the mold 17 in a condition where tension is applied by a press-bonding rolls 18 and 19 which are arranged in the delivery upstream side and downstream side, respectively, but also the sheet section 2 passing through the press-bonding roll 19 is wound up by a sheet winding means (not illustrated). A nozzle 20, which supplies the photocurable resin, is arranged above the press-bonding roll 18 such that the resin supplied from the nozzle 20 flows into and fills the cavities 17*a* of the mold 17, and plural light sources 21 which irradiate a specific beam of light are arranged below the mold 17 such that the photocurable resin filled into the cavities 17*a* is irradiated with the specific beam of light through the sheet section 2 and thereby cured. The mold 17 is provided such that it rotates in synchronization with the sheet transfer rate of the sheet supply means and the sheet winding means.

In this mode, the uneven sheet member 1 can be molded by the following procedure. First, the tip of the elongated sheet-like sheet section 2 is drawn out from the sheet supply means and wound on the peripheral surface of the mold 17 and, at the same time, the sheet section 2 is wound on the press-bonding rolls 18 and 19 and tension is applied thereto, and the tip of the sheet section 2 is attached to the sheet winding means. Subsequently, the sheet section 2 is supplied from the sheet supply means and, while winding up the sheet section 2 using the sheet winding means, the sheet section 2 is wound on the rotating mold 17 and, simultaneously, the photocurable resin is discharged from the nozzle 20 and filled into the cavities 17*a* of the mold 17. In the process in which the sheet section 2 wound on the mold 17 is rotationally transferred to the side of the press-bonding roll 19 along with the mold 17, the surface of the sheet section 2 is irradiated with the specific beam of light emitted from the light sources 21 arranged below the mold 17, and the photocurable resin inside the cavities 17*a* is irradiated with the specific beam of light through the sheet section 2, as a result of which the photocurable resin is cured and immobilized on the surface of the sheet section 2. The transfer rate of the sheet section 2 wound on the mold 17 (the rotational speed of the mold 17) is set such that the photocurable resin inside the cavities 17*a* receives the specific beam of light irradiated from the light sources 21 and is completely cured while the sheet section 2 is wound on the mold 17. Thereafter, the sheet section 2 is peeled off from the mold 17 via the press-bonding roll 19, and this sheet section 2 on which the protruding parts 5 have been immobilized is wound up by the sheet winding means, whereby an elongated uneven sheet member 1 is continuously formed. By cutting the thus wound sheet section 2 in dimensions corresponding to the position of arrangement, the uneven sheet member 1 of a desired size, in which the uneven structure 3 is formed on the surface of the sheet section 2, can be obtained. The cavities 16*a* and 17*a* on the molds 16 and 17, respectively, are formed linearly along the profile of the protruding parts 5; therefore, the resin flows uniformly along the cavities 16*a* and 17*a*, making air bubbles unlikely to be introduced to the cavities 16*a* and 17*a* together with the resin.

Figure 12:
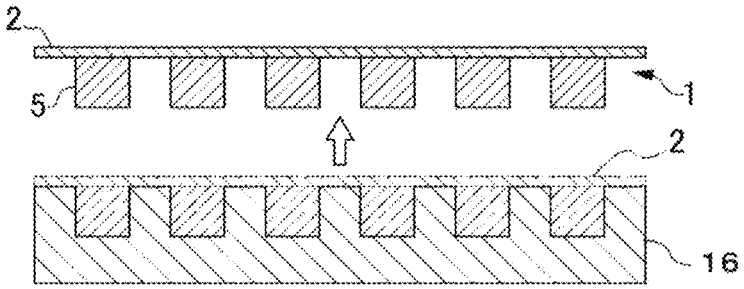
FIG. 12 is a drawing for describing the steps of producing an uneven sheet member using the mold of FIG. 13.

When the uneven sheet member 1 is produced in the mode illustrated in FIGS. 11 to 13, a member having protruding shapes can be provided on a sheet supplied to the rolls, and a member having an uneven structure can also be provided on a sheet supplied to the rolls. In the former case, the resulting uneven sheet member 1 has a structure which includes the sheet section 2 composed of the sheet supplied to the rolls and the protruding parts 5 molded in a roll-to-roll manner, while in the latter case, the resulting uneven sheet member 1 has a structure which includes the sheet section 2 composed of two layers of the sheet supplied to the rolls and another sheet molded in a roll-to-roll manner, and the protruding parts 5 molded in a roll-to-roll manner. In this mode, for example, any of the materials described above for the sheet section can be applied as the material of the sheet supplied to the rolls, and any of the materials described above for the protruding parts can be applied as the material of the sheet and/or the protruding parts that are molded in a roll-to-roll manner.

[Flexible Member]

The sound-insulating structural body 7 includes the flexible member 8. The flexible member 8 is provided on the adherend 9 and sandwiched between the adherend 9 and the uneven sheet member 1. The shape of the flexible member 8 is not particularly limited as long as the flexible member 8 can be provided such that it is arranged between the uneven sheet member 1 and the adherend; however, the flexible member 8 is preferably in the form of a sheet.

As for a method of providing the flexible member 8 on the adherend 9, as described above, an adhesive layer or the like may be provided between the uneven sheet member 1 and the flexible member 8. The uneven sheet member 1 may be pasted to the flexible member 8 using a pressure-sensitive adhesive agent, an adhesive, a double-sided adhesive tape, or a duct tape, or may be physically immobilized on the flexible member 8 using a tacker or a stapler. The uneven sheet member and the flexible member are preferably adhered via an adhesive layer since this does not require other structure for maintaining the structure. Further, from the standpoint of adhesive strength, the adhesive layer preferably has a storage elastic modulus of not less than 0.05 MPa. The uneven sheet member and the flexible member does not have to be immobilized with each other, or may be in the state of being tightly adhered with each other. The uneven sheet member 1 may be oriented such that its uneven surface is positioned on the side of the flexible member, and the flexible member 8 may be arranged on both surfaces 2*a* and 2*b* of the sheet section of the uneven sheet member 1.

The flexible member 8 is arranged at least between the uneven sheet member 1 and the adherend 9, and functions in such a manner to prevent the vibration of the sheet section 2 of the uneven sheet member 1 from being inhibited by contact with the adherend 9. As the flexible member 8, from the standpoint of not inhibiting the vibration of the sheet section 2 of the uneven sheet member 1 even when the flexible member 8 comes into contact therewith, it is preferred to use a material that can be easily deformed and conform to the vibrational displacement of the sheet section. Specifically, in the flexible member 8, from the standpoint of obtaining a high sound insulation effect also for a sound wave having a relatively low sound pressure, the load giving a deformation rate of 4% in a compression test is preferably 160 kPa or less, more preferably 120 kPa or less. The material of the flexible member 8 is not particularly limited as long as this value is satisfied, and examples of a material that can be used include: a fiber-based sound absorbing material made of a polymer or inorganic fibers such as glass wool; rock wool; a felt; a blanket; a nonwoven fabric; a polymer foamed body of urethane, rubber, polyethylene, polystyrene, polypropylene, or the like; and an inorganic porous body or a metal foamed material, or a porous material obtained by solidification and molding of a pulverized product of an inorganic porous body or a metal foamed material, a fiber waste, or the like using various binders. These materials may be used singly, or a plurality thereof may be used in combination. Thereamong, from the standpoint of obtaining a high sound insulation effect also for a sound wave having a relatively low sound pressure, a nonwoven fabric, a foamed body such as a polymer foamed body or a metal foamed body, glass wool, a felt, or a blanket is preferred, and a nonwoven fabric or a foamed body is particularly preferred. These materials may be used singly, or in any combination of two or more thereof.

Further, while the flexible member is preferably soft as described above from the standpoint of not inhibiting the vibration of the uneven sheet member, the load giving a deformation rate of 4% in a compression test is preferably not less than 0.15 kPa from the standpoint of maintaining the strength as a structural body. This is because, by imparting such a strength to the flexible member, a member other than the flexible member is no longer required for maintaining the strength, which is preferred from the standpoint of arrangement and production.

In the above-described compression test, measurement is performed in accordance with the following method.

The compression test is conducted to measure the hardness of the flexible member using a compression tester (e.g., compression tester/texture analyzer CT3-4500, manufactured by Brookfield Engineering Laboratories, Inc.). In this process, a load is applied perpendicular to the thickness direction of the flexible member at a rate of 0.1 mm/s using an acrylic cylindrical probe of 12.7 mm in diameter and 35 mm in height, and the deformation rate and the load are measured. The surface of the flexible member to which the load is applied is a flat surface having a larger area than the bottom surface of the cylindrical probe.

From the standpoint of inhibiting an increase in size while not inhibiting the vibration of the sheet section of the uneven sheet member, the thickness of the flexible member 8 is preferably 0.2 μm or more and 100 mm or less, more preferably 0.5 μm or more and 50 mm or less, still more preferably 1 μm or more and 30 mm or less.

[Adherend]

The sound-insulating structural body 7 includes the adherend 9 on which the above-described flexible member 8 is arranged (adhered). The adherend 9 is arranged on the surface of the flexible member 8 in the opposite side of the side in which the uneven sheet member 1 exists.

The material constituting the adherend 9 is not particularly limited as long as it can support the flexible member 8 on which the uneven sheet member 1 is provided.

Specific examples of the material constituting the adherend 9 include, but not particularly limited to: organic materials, such as polyacrylonitrile, polyethylene terephthalate, polybutylene terephthalate, polyethylene naphthalate, polyvinyl chloride, polyvinylidene chloride, polychlorotrifluoroethylene, polyethylene, polypropylene, polystyrene, cyclic polyolefin, polynorbornene, polyether sulfone, polyether ether ketone, polyphenylene sulfide, polyarylate, polycarbonate, polyamide, polyimide, triacetylcellulose, polystyrene, epoxy resins, acrylic resins, and oxazine resins; and composite materials containing a metal (e.g., aluminum, stainless steel, iron, copper, zinc, or brass), an inorganic glass, or inorganic particles or fibers in the above-exemplified organic materials. Particularly, from the standpoint of sound insulation performance, rigidity, moldability, cost and the like, the adherend 9 is preferably at least one selected from the group consisting of photocurable resin sheets, thermosetting resin sheets, thermoplastic resin sheets, metal plates, and alloy plates.

The thickness and area density of the adherend 9 are not particularly limited; however, from the standpoint of sound insulation performance, rigidity, moldability, weight reduction, cost and the like, the thickness is usually preferably 0.01 mm or more and 50 mm or less, more preferably 0.05 mm or more and 25 mm or less, still more preferably 0.1 mm or more and 10 mm or less, and the area density is preferably 2.0 kg/m$^2$ or less, more preferably 1.5 kg/m$^2$ or less, but usually not less than 0.5 kg/m$^2$.

One effect of the present invention is that a high sound insulation effect is obtained even when the uneven sheet member 1 is arranged on a member having a high rigidity, and this effect can be obtained even if, for example, an adherend having a Young's modulus of 1 GPa or more is used. An upper limit of the Young's modulus is not particularly limited; however, it is, for example, 1,000 GPa or less.

The shape of the adherend 9 is not particularly limited and can be set as appropriate in accordance with the surface on which the flexible member 8 is to be arranged. For example, the adherend 9 may have a flat sheet-like shape, a curved sheet-like shape, or a special shape processed to have a curved portion, a bent portion, or the like. Further, from the standpoint of weight reduction and the like, for example, a notch or a punched hole may be formed on the adherend 9.

[Other Members]

The sound-insulating structural body 7 may also include a member (other member) in addition to the above-described uneven sheet member 1, flexible member 8, and adherend 9 within a range where the effects of the present invention can be obtained, and examples of the other member include a heat insulating material and a non-combustible material. Such other member can be arranged, for example, between the uneven sheet member 1 and the flexible member 8.

Another embodiment of the present invention is a sound-insulating sheet including at least an uneven sheet member and a flexible member, specifically a sound-insulating sheet including: an uneven sheet member having an uneven structure which includes a sheet section and plural protruding parts provided on a surface of the sheet section; and a flexible member provided on the uneven sheet member, wherein in the flexible member, a load giving a deformation rate of 4% in a compression test performed by a compression tester is 160 kPa or less, and in the uneven sheet member, the protruding parts and the sheet section have a weight ratio, which is represented by (weight of protruding parts/weight of sheet section), of 0.7 or higher.

The term "sound-insulating sheet" used herein means a member that includes an uneven sheet member and a flexible member.

As the conditions and properties of the sound-insulating sheet according to the present embodiment and those of the members and other members that constitute the sound-insulating sheet, the conditions and properties of the sound-insulating sheet member in the above-described sound-insulating structural body and those of the members and other members that constitute the sound-insulating sheet member can be applied in the same manner. In other words, the sound-insulating sheet according to the present invention may be handled as the above-described sound-insulating structural body from which the adherend element is excluded. It is noted here, however, that the sound-insulating sheet according to the present embodiment may include the above-described adherend and, in this case, the sound-insulating sheet can be a sound-insulating structural body which includes the adherend on which the above-described flexible member is arranged, and in which this flexible member is provided such that it is arranged between the adherend and the above-described uneven sheet member.

<2. Method of Producing Sound-Insulating Structural Body>

A method of producing the sound-insulating structural body 7 is not particularly limited. The sound-insulating structural body 7 can be produced by, for example, adhering the flexible member 8 to the surface of the uneven sheet member 1 via an adhesive or the like on the side not having the uneven structure 3, and further adhering an adherend to the surface of the flexible member 8 via an adhesive or the like on the side opposite of the surface adhered with the uneven sheet member 1.

The uneven sheet member 1 can be produced by a method of separately molding the protruding parts 5 and the sheet section 2 and subsequently adhering them via an adhesive or the like, or a method of integrally molding the protruding parts 5 and the sheet section 2 using a mold having the cavities of the uneven structure 3. The flexible member 8 can be produced by any known method, and a commercially available product may be used as the flexible member 8. At the time of molding the uneven sheet member 1, a resin or the like used as a raw material of the uneven sheet member 1 is cured in contact with the flexible member, whereby the uneven sheet member 1 and the flexible member 8 can be adhered without using an adhesive material such as an adhesive.

<3. Properties of Sound-Insulating Structural Body>

[Sound Insulation Properties]

As an evaluation of a sound insulation property of the sound-insulating structural body, the sound transmission loss was measured. The measurement conditions of the sound transmission loss are described below.

When white noise was generated in one of two spaces separated by the sound-insulating structural body as a boundary, the sound transmission loss (TL) was determined based on the following equation (1) from the difference between the sound pressure level at a prescribed position in the space where white noise was generated (sound source room) and the sound pressure level at a prescribed position in the other space (sound receiving room), for each center frequency of a 1/12 octave band of 72.8 Hz to 10,900 Hz.

$$TL\ [\text{dB}]=L_{in}-L_{out}-3 \quad (1)$$

Lin: sound pressure level (dB) in sound source room

Lout: sound pressure level (dB) in sound receiving room

Incident sound: white noise (e.g. sound having an average sound pressure value of about 0.94 Pa in a frequency range of 72.8 to 10,900 Hz)

Sample-microphone distance: 10 mm

It is preferred that the sound-insulating structural body 7 satisfy the conditions represented by the following equations (A) to (C) simultaneously. Satisfaction of the following conditions indicates that a high sound insulation effect can be obtained by arranging the sound-insulating structural body in a desired orientation.

$$(TL_1-TL_2)-(TL_3-TL_4)>3\ \text{dB} \quad (A)$$

$$TL_1-TL_2>0\ \text{dB} \quad (B)$$

$$TL_3-TL_4>0\ \text{dB} \quad (C)$$

$TL_1$ (dB): sound transmission loss of the sound-insulating structural body in a case where the side of the uneven sheet member is arranged to face the sound source $TL_2$ (dB): sound transmission loss of the sound-insulating structural body in a case where, under the condition of the $TL_1$, the uneven sheet member is replaced with a smooth flat sheet having the same mass and area $TL_3$ (dB): sound transmission loss of the sound-insulating structural body in a case where the side of the adherend is arranged to face the sound source $TL_4$ (dB): sound transmission loss of the sound-insulating structural body in a case where, under the condition of the $TL_3$, the uneven sheet member is replaced with a smooth flat sheet having the same mass and area The $TL_1$ and the $TL_2$ each represent the sound transmission loss at a frequency at which the value of $(TL_1-TL_2)$ is the largest, and the $TL_3$ and the $TL_4$ each represent the sound transmission loss at a frequency at which the value of $(TL_3-TL_4)$ is the largest.

Usually, the frequency at which the value of $(TL_1-TL_2)$ is the largest is a frequency at which the largest peak value (maximum peak value) is observed in a graph obtained by plotting the frequency on the abscissa and $(TL_1-TL_2)$ on the ordinate, and the frequency at which the value of $(TL_3-TL_4)$ is the largest is a frequency at which the largest peak value (maximum peak value) is observed in a graph obtained by plotting the frequency on the abscissa and $(TL_3-TL_4)$ on the ordinate. The peak values in Examples mean these peak values.

When the above-described conditions of the equations (A) to (C) are satisfied, from the standpoint of enhancing the effect of improving the sound insulation performance that is obtained by controlling the arrangement orientation of the sound-insulating structural body, the value of the left-hand side of the equation (A) is preferably greater than 3, more preferably greater than 4, still more preferably greater than 5, particularly preferably greater than 7, especially preferably greater than 8, most preferably greater than 10. Examples of a method of satisfying the equation (A) include a method of producing a sound-insulating structural body by pasting each side of an uneven sheet member in which elongated rectangular parallelepiped protruding parts 5, which are made of urethane acrylate and have a width of 6 mm, a height of 5 mm, and a pitch of 20 mm, are arrayed in a single direction on a 250 μm-thick PET substrate, to ultrafine acrylic fibers XAI (registered trademark) (basis weight: 1,000 g/m$^2$, thickness: 25 mm) using a double-sided adhesive tape, and further pasting each side of the reverse surface of the uneven sheet member to the surface of an adherend 9 made of a 0.6-mm steel sheet.

Satisfaction of the conditions of the equations (A) to (C) indicates that a high sound insulation effect can be obtained by arranging the sound-insulating structural body in a desired orientation. Further, by applying the technology of the present invention to a conventional sound-insulating member, the sound insulation properties obtained by the conventional sound-insulating member are expected to be improved.

EXAMPLES

The present invention will now be described in more detail by way of Examples; however, the present invention is not limited to the below-described Examples within the gist of the present invention. It is noted here that various conditions and values of evaluation results in the below-described Examples indicate a preferred scope of the present invention in the same manner as the preferred ranges in the above-described embodiments of the present invention. The preferred scope of the present invention can be determined taking into consideration a scope represented by the preferred ranges in the above-described embodiments and the values in the below-described Examples or a combination thereof.

Example 1

Raw materials were weighed at a mass ratio [EBECRYL 230 (manufactured by DAICEL-ALLNEX Ltd., urethane acrylate, weight-average molecular weight Mw: 5,000)/ARONIX M-120 (manufactured by Toagosei Co., Ltd., special acrylate)/IRGACURE 184 (manufactured by BASF Ltd., 1-hydroxy-cyclohexyl-phenyl-ketone)/IRGACURE TPO (manufactured by BASF Ltd., 2,4,6-trimethylbenzoyl-diphenyl-phosphine oxide)] of 50/50/1/0.1, and these raw materials were mixed using a THINKY MIXER AR-250 (manufactured by Thinky Corporation) under the condition of 20-minute stirring and 10-minute degassing to obtain a mixture BL.

The thus obtained mixture BL was poured into an aluminum A4-size mold 16 on which recessed groove shapes (cavities) of 6 mm in width and 5 mm in height were arrayed in one direction at a pitch of 20 mm as illustrated in FIGS. 11 to 13 and, subsequently, as a material of a sheet section 2, a 250 μm-thick PET film having a Young's modulus of about 4 GPa, a specific gravity of 1.4, and an area density of 0.175 kg/m$^2$ was placed on the mold, and curing was performed by irradiation with an ultraviolet light having a wavelength of 200 nm to 450 nm at an energy dose of 1,000 mJ/m$^2$ using a high-pressure mercury lamp 21 to mold an uneven sheet member 1. Thereafter, the uneven sheet member 1 thus cured in the mold was peeled off from the mold.

The thus obtained uneven sheet member 1 was substantially the same as the one illustrated in FIG. 1, and had a form in which a 0.05 mm-thick thin film formed by curing of the mixture BL was laminated on the 250 μm-thick PET film and elongated rectangular parallelepiped protruding parts 5 of 6 mm in width and 5 mm in height were arrayed at a pitch of 20 mm in one direction on the thin film.

Figure 10:
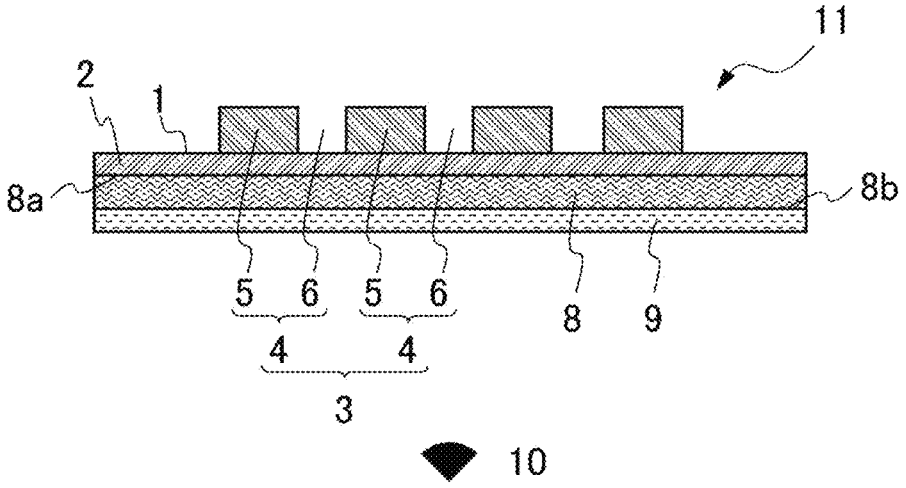
FIG. 10 is a schematic cross-sectional view that illustrates another embodiment of the sound-insulating structural body according to one embodiment of the present invention.

Each side of this uneven sheet member 1 was pasted to a surface 8*a* of a flexible member 8 made of ultrafine acrylic fibers XAI (registered trademark) (basis weight: 1,000 g/m$^2$, thickness: 25 mm) using a double-sided adhesive tape, and each side of a reverse surface 8*b* of the flexible member 8 was pasted to a surface of an adherend 9 made of a 0.6 mm-thick steel sheet, whereby a sound-insulating structural body was produced. Here, a sound-insulating structural body in which the uneven sheet member 1, the flexible member 8, and the adherend 9 were arranged such that they were laminated in the order mentioned when viewed from a sound source 10 as illustrated in FIG. 9 was defined as "sound-insulating structural body 7". Meanwhile, a sound-insulating structural body in which the adherend 9, the flexible member 8, and the uneven sheet member 1 were arranged such that they were laminated in the order mentioned when viewed from the sound source 10 as illustrated in FIG. 10 was defined as "sound-insulating structural body 11".

Example 2

Sound-insulating structural bodies 7 and 11 were produced in the same manner as in Example 1, except that the unevenness pitch of the uneven sheet member 1 was changed to 30 mm.

Example 3

Sound-insulating structural bodies 7 and 11 were produced in the same manner as in Example 1, except that the flexible member 8 was changed to a 10 mm-thick urethane foam.

Example 4

Sound-insulating structural bodies 7 and 11 were produced in the same manner as in Example 1, except that the flexible member 8 was changed to a 12.5 mm-thick sheet of crystalline alumina fibers MAFTEC (registered trademark).

Example 5

Sound-insulating structural bodies 7 and 11 were produced in the same manner as in Example 1, except that the flexible member 8 was changed to a 20 mm-thick styrofoam.

Example 6

Figure 14:
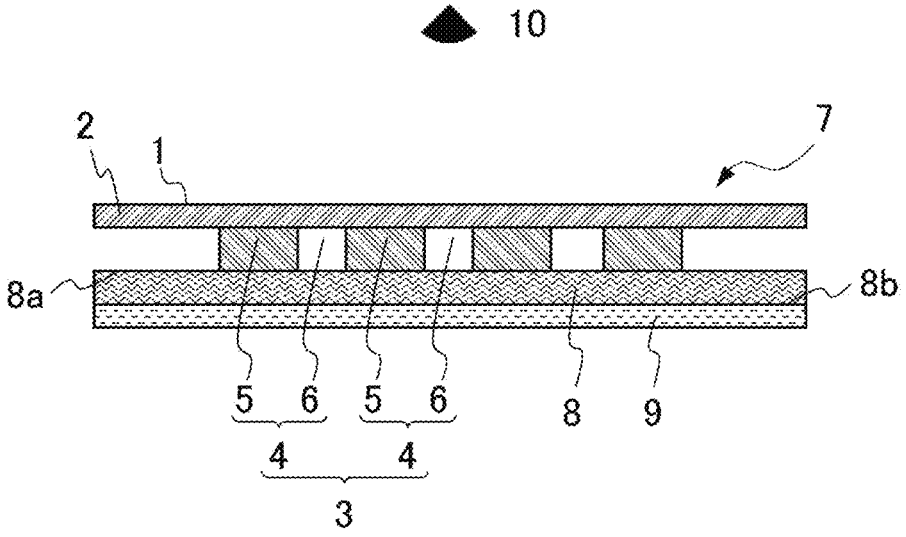
FIG. 14 is a schematic cross-sectional view that illustrates yet another embodiment of the sound-insulating structural body according to one embodiment of the present invention.

Sound-insulating structural bodies 7 and 11 were produced in the same manner as in Example 1, except that the surface of the uneven sheet member 1 on which the uneven structure 3 was provided was changed to the side of the flexible member 8 so that the mode illustrated in FIG. 9 was changed to the mode illustrated in FIG. 14.

Example 7

Sound-insulating structural bodies 7 and 11 were produced in the same manner as in Example 1, except that the thickness of the PET film of the uneven sheet member 1 was changed from 250 μm to 125 μm, and the uneven structure 3 was changed from a linear uneven structure having a width of 6 mm, a height of 5 mm, and a pitch of 20 mm to the dot-like uneven structure illustrated in FIG. 6 which was composed of cylindrical protruding parts having a diameter of 6 mm, a height of 5 mm, and an unevenness pitch of 18 mm.

Comparative Example 1

Sound-insulating structural bodies 7 and 11 were produced in the same manner as in Example 1, except that flexible member 8 was changed to a 4 mm-thick acrylic plate.

[Measurement of Sound Transmission Loss]

The sound transmission loss was measured using each of the sound-insulating structural bodies produced in Examples 1 to 6 and Comparative Example 1. Tables 1-1 and 1-2 summarize the difference of the thus measured sound transmission loss, taking the value measured when the uneven sheet member 1 of each sound-insulating structural body was replaced with a smooth flat sheet of the same mass as a reference. In Tables 1-1 and 1-2, "Peak value (dB) of difference in transmission loss from case of using flat sheet of same mass" represents "$TL_1-TL_2$" in the above-described equations (A) to (C) when the member on the sound wave incident side was an uneven sheet member, while "Peak value (dB) of difference in transmission loss from case of using flat sheet of same mass" represents "$TL_3-TL_4$" in the above-described equations (A) to (C) when the member on the sound wave incident side was an adherend. The measurement conditions of the sound transmission loss are described below.

When white noise was generated in one of two spaces separated by each of the sound-insulating structural bodies produced in Examples 1 to 6 and Comparative Example 1 as a boundary, the sound transmission loss (TL) was determined based on the following equation (1) from the difference between the sound pressure level at a prescribed position in the space where white noise was generated (sound source room) and the sound pressure level at a prescribed position in the other space (sound receiving room), for each center frequency of a 1/12 octave band of 72.8 Hz to 10,900 Hz.

$$TL\ [\text{dB}]=L_{in}-L_{out}-3 \quad (1)$$

Lin: sound pressure level (dB) in sound source room

Lout: sound pressure level (dB) in sound receiving room

Incident sound: white noise (having an average sound pressure value of about 0.94 Pa in a frequency range of 72.8 to 10,900 Hz)

Sample-microphone distance: 10 mm

[Compression Test]

A compression test was conducted to measure the hardness of various flexible members using a compression tester/texture analyzer CT3-4500 (manufactured by Brookfield Engineering Laboratories, Inc.). A load was applied perpendicular to the thickness direction of each flexible member at a rate of 0.1 mm/s using an acrylic cylindrical probe of 12.7 mm in diameter and 35 mm in height, and the deformation rate and the load were measured. The surface of the flexible member to which the load was applied was a flat surface having a larger area than the bottom surface of the cylindrical probe.

Table 2 summarizes the load (kPa) applied to various flexible members at a deformation rate of 4%.

In Tables 1-1 and 1-2, "Flexible member" represents a flexible member or a member (i.e. an acrylic plate in Comparative Example 1) existing at the same position as the flexible member.

TABLE 1-1

| | Example 1 | | Example 2 | | Example 3 | | Example 4 | | Example 5 | |
|---|---|---|---|---|---|---|---|---|---|---|
| Unevenness pitch (mm) | 20 | 20 | 30 | 30 | 20 | 20 | 20 | 20 | 20 | 20 |
| Orientation of unevenness | opposite side of flexible member | opposite side of flexible member | opposite side of flexible member | opposite side of flexible member | opposite side of flexible member | opposite side of flexible member | opposite side of flexible member | opposite side of flexible member | opposite side of flexible member | opposite side of flexible member |
| Adherend | steel plate | steel plate | steel plate | steel plate | steel plate | steel plate | steel plate | steel plate | steel plate | steel plate |
| flexible member | XAI | XAI | XAI | XAI | foamed urethane | foamed urethane | MAFTEC | MAFTEC | styrofoam | styrofoam |
| Thickness of flexible member (mm) | 25 | 25 | 25 | 25 | 10 | 10 | 12 | 12 | 20 | 20 |

TABLE 1-1-continued

| | Example 1 | | Example 2 | | Example 3 | | Example 4 | | Example 5 | |
|---|---|---|---|---|---|---|---|---|---|---|
| Unevenness pitch (mm) | 20 | 20 | 30 | 30 | 20 | 20 | 20 | 20 | 20 | 20 |
| Member on sound wave incident side | Uneven sheet | Adherend | Uneven sheet | Adherend | Uneven sheet | Adherend | Uneven sheet | Adherend | Uneven sheet | Adherend |
| Peak value (dB) of difference in transmission loss from case of using flat sheet of same mass | 14.16 | 3.2 | 15.54 | 7.47 | 16.32 | 4.22 | 10.74 | 4.23 | 6.4 | 1.81 |
| Frequency at peak of difference in transmission loss (Hz) | 818 | 818 | 460 | 487 | 818 | 917 | 818 | 728 | 818 | 818 |

TABLE 1-2

| | Example 6 | | Example 7 | | Comparative Example 1 | |
|---|---|---|---|---|---|---|
| Unevenness pitch (mm) | 20 | 20 | 18 | 18 | 20 | 20 |
| Orientation of unevenness | same side as flexible member | same side as flexible member | opposite side of flexible member | opposite side of flexible member | opposite side of flexible member | opposite side of flexible member |
| Adherend | steel plate | steel plate | steel plate | steel plate | steel plate | steel plate |
| flexible member | XAI | XAI | XAI | XAI | acrylic plate | acrylic plate |
| Thickness of flexible member (mm) | 25 | 25 | 25 | 25 | 4 | 4 |
| Member on sound wave incident side | Uneven sheet | Adherend | Uneven sheet | Adherend | Uneven sheet | Adherend |
| Peak value (dB) of difference in transmission loss from case of using flat sheet of same mass | 17.37 | 5.91 | 6.74 | 0.5 | 1.8 | 0.9 |
| Frequency at peak of difference in transmission loss (Hz) | 818 | 818 | 688 | 688 | 866 | 818 |

TABLE 2

| Load value at deformation rate of 4% | | | | |
|---|---|---|---|---|
| XAI | Foamed urethane | MAFTEC | Styrofoam | Acrylic plate |
| 0.581 | 0.194 | 0.410 | 112 | 206 |

As shown in Tables 1 above, it is seen from Examples 1 to 7 that the sound-insulating structural bodies in which the members were laminated such that a sound wave was input thereto from the uneven sheet side exhibited superior sound insulation performance in the sound insulation frequency band of the uneven sheet as compared to the sound-insulating structural bodies in which the members were laminated such that a sound wave was input thereto from the adherend side. In addition, as shown in Table 2 above, it is seen that, in Comparative Example 1 where a hardly deformable member having a high rigidity was used as the flexible member, the sound insulation performance in the sound insulation frequency band of the uneven sheet was markedly deteriorated as compared to Examples 1 to 7 due to inhibition of the vibration of the sheet section of the uneven sheet, regardless of the lamination order. From these results, it was confirmed that the sound insulation performance in the sound insulation frequency band of the uneven sheet was improved in the sound-insulating structural bodies in which a low-rigidity member capable of conforming to the vibration of the sheet section of the uneven sheet was employed as the flexible member and the uneven sheet, the flexible member, and the adherend were laminated such that an incident sound passes through these members in the order mentioned.

Reference Examples

[Simulation]

A unit cell portion having substantially the same shape as the one illustrated in FIG. 1 or FIG. 6, in which an uneven structure was imparted to the sheet section 2, was reproduced on a simulation software COMSOL Multiphysics (registered trademark) to construct an infinite plane model to which periodic boundary condition was applied. The physical properties of the sheet section and the protruding parts were set as those of Models 1 to 41 shown in Table 3 below. On the sheet section surface on which protruding parts were arranged, a 0.05 mm-thick photocurable resin thin film existed, and the protruding parts made of a photocurable resin were arranged thereon. The photocurable resin had a density of 1,050 kg/m$^2$, a Poisson ratio of 0.49, and a loss coefficient of 0.1. As the elastic modulus of the photocurable resin, a value calculated by the following equation (3) was used.

$$E(Pa)=10^{0.5513\ \log10(f+5.6991)} \quad (3)$$

E: elastic modulus of photocurable resin (Pa)

f: frequency (Hz)

Figure 15:
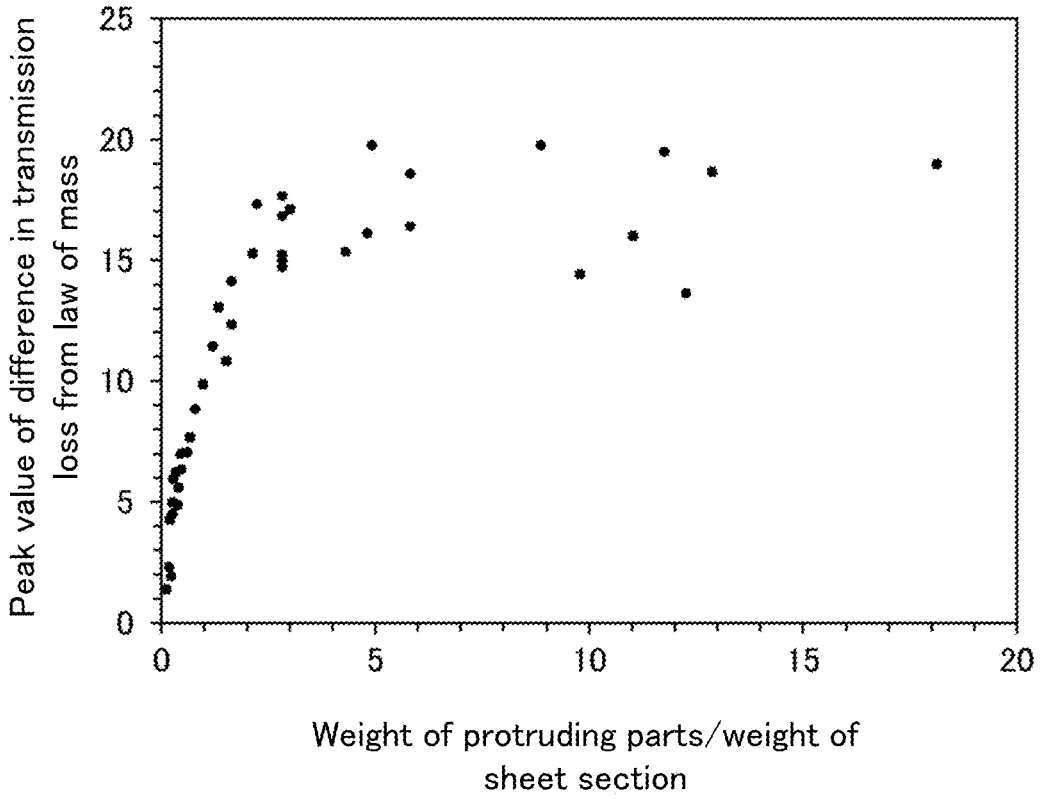
FIG. 15 is a graph showing the relationship between the peak value of difference in transmission loss from the law of mass and the weight ratio (weight of protruding parts/weight of sheet section) in Shape Models 1 to 41.

The sound transmission loss was simulated for each of the sound-insulating structural bodies of Shape Models 1 to 41 shown in Table 3 below. The simulated sound transmission loss value of the uneven sheet of each shape was compared with a value that was obtained based on the law of mass when the uneven sheet of each shape was replaced with a smooth flat sheet having the same mass and area as the uneven sheet. FIG. 15 shows a graph that was obtained in this case by plotting the weight ratio (weight of protruding parts/weight of sheet section) on the abscissa and the peak value of the difference, which was calculated by subtracting the value based on the law of mass from the value of the sound transmission loss with the use of each uneven sheet, on the ordinate.

From the results thereof, it is seen that an excellent sound insulation effect is obtained when the weight ratio (weight of protruding parts/weight of sheet section) is preferably 0.7 or higher, more preferably 2.0 or higher. It is noted here that, with regard to the relationship between the peak value of the difference and the weight ratio (weight of protruding parts/weight of sheet section), the same tendency is observed also when the flexible member described above in the paragraphs describing embodiments is arranged.

TABLE 3-1

| | Elastic modulus of sheet section (GPa) | Density of sheet section (kg/m$^3$) | Thickness of sheet section (mm) | Poisson ratio of sheet section |
|---|---|---|---|---|
| Shape 1 | 0.5 | 1200 | 0.25 | 0.39 |
| Shape 2 | 1.3 | 1200 | 0.25 | 0.39 |

TABLE 3-1-continued

| | Elastic modulus of sheet section (GPa) | Density of sheet section (kg/m$^3$) | Thickness of sheet section (mm) | Poisson ratio of sheet section |
|---|---|---|---|---|
| Shape 3 | 5 | 1200 | 0.25 | 0.39 |
| Shape 4 | 50 | 1200 | 0.25 | 0.39 |
| Shape 5 | 200 | 1200 | 0.25 | 0.39 |
| Shape 6 | 5 | 10 | 0.25 | 0.39 |
| Shape 7 | 5 | 100 | 0.25 | 0.39 |
| Shape 8 | 5 | 10000 | 0.25 | 0.39 |
| Shape 9 | 5 | 15000 | 0.25 | 0.39 |
| Shape 10 | 5 | 20000 | 0.25 | 0.39 |
| Shape 11 | 5 | 1200 | 0.05 | 0.39 |
| Shape 12 | 5 | 1200 | 0.125 | 0.39 |
| Shape 13 | 5 | 1200 | 0.5 | 0.39 |
| Shape 14 | 5 | 1200 | 1 | 0.39 |
| Shape 15 | 5 | 1200 | 2 | 0.39 |
| Shape 16 | 5 | 1200 | 3 | 0.39 |
| Shape 17 | 5 | 1200 | 0.25 | 0.39 |
| Shape 18 | 5 | 1200 | 0.25 | 0.39 |
| Shape 19 | 5 | 1200 | 0.25 | 0.39 |
| Shape 20 | 5 | 1200 | 0.25 | 0.39 |
| Shape 21 | 5 | 1200 | 0.25 | 0.39 |
| Shape 22 | 206 | 7870 | 0.25 | 0.3 |
| Shape 23 | 206 | 7870 | 0.05 | 0.3 |
| Shape 24 | 206 | 7870 | 0.1 | 0.3 |
| Shape 25 | 206 | 7870 | 0.2 | 0.3 |
| Shape 26 | 5 | 1200 | 0.6 | 0.39 |
| Shape 27 | 5 | 1200 | 0.25 | 0.39 |
| Shape 28 | 5 | 1200 | 0.25 | 0.39 |
| Shape 29 | 5 | 1200 | 0.25 | 0.39 |
| Shape 30 | 5 | 1200 | 0.25 | 0.39 |
| Shape 31 | 5 | 1200 | 0.25 | 0.39 |
| Shape 32 | 5 | 1200 | 0.25 | 0.39 |
| Shape 33 | 5 | 1200 | 0.25 | 0.39 |
| Shape 34 | 5 | 1200 | 0.25 | 0.39 |
| Shape 35 | 5 | 1200 | 0.25 | 0.39 |
| Shape 36 | 5 | 1200 | 0.25 | 0.39 |
| Shape 37 | 5 | 10 | 0.25 | 0.39 |
| Shape 38 | 5 | 100 | 0.25 | 0.39 |
| Shape 39 | 5 | 1200 | 0.25 | 0.39 |
| Shape 40 | 5 | 5000 | 0.25 | 0.39 |
| Shape 41 | 5 | 1200 | 0.25 | 0.39 |

TABLE 3-2

| | Shape of protruding parts | Height of protruding parts (mm) | Width/diameter of protruding parts (mm) | Pitch of protruding parts (mm) | Weight of protruding parts/weight of sheet section | Peak value of difference in transmission loss from law of mass |
|---|---|---|---|---|---|---|
| Shape 1 | linear | 5 | 6 | 30 | 3 | 17.63 |
| Shape 2 | linear | 5 | 6 | 30 | 3 | 16.79 |
| Shape 3 | linear | 5 | 6 | 30 | 3 | 14.95 |
| Shape 4 | linear | 5 | 6 | 30 | 3 | 15.21 |
| Shape 5 | linear | 5 | 6 | 30 | 3 | 14.66 |
| Shape 6 | linear | 5 | 6 | 30 | 18 | 18.94 |
| Shape 7 | linear | 5 | 6 | 30 | 13 | 18.63 |
| Shape 8 | linear | 5 | 6 | 30 | 0 | 4.85 |
| Shape 9 | linear | 5 | 6 | 30 | 0 | 4.93 |
| Shape 10 | linear | 5 | 6 | 30 | 0 | 4.23 |
| Shape 11 | linear | 5 | 6 | 30 | 9 | 19.73 |
| Shape 12 | linear | 5 | 6 | 30 | 5 | 19.74 |
| Shape 13 | linear | 5 | 6 | 30 | 2 | 10.80 |
| Shape 14 | linear | 5 | 6 | 30 | 1 | 8.81 |
| Shape 15 | linear | 5 | 6 | 30 | 0 | 5.54 |
| Shape 16 | linear | 5 | 6 | 30 | 0 | 5.93 |
| Shape 17 | linear | 0.7 | 6 | 30 | 0 | 4.47 |
| Shape 18 | linear | 1 | 6 | 30 | 0 | 6.94 |
| Shape 19 | linear | 3 | 6 | 30 | 2 | 12.30 |
| Shape 20 | linear | 10 | 6 | 30 | 6 | 18.55 |
| Shape 21 | linear | 20 | 6 | 30 | 12 | 19.44 |
| Shape 22 | linear | 5 | 6 | 30 | 2 | 17.28 |
| Shape 23 | linear | 5 | 6 | 30 | 1 | 11.41 |
| Shape 24 | linear | 5 | 6 | 30 | 1 | 7.01 |

TABLE 3-2-continued

| | Shape of protruding parts | Height of protruding parts (mm) | Width/diameter of protruding parts (mm) | Pitch of protruding parts (mm) | Weight of protruding parts/weight of sheet section | Peak value of difference in transmission loss from law of mass |
|---|---|---|---|---|---|---|
| Shape 25 | linear | 5 | 6 | 30 | 0 | 1.90 |
| Shape 26 | linear | 5 | 1 | 30 | 0 | 6.19 |
| Shape 27 | linear | 5 | 3 | 30 | 1 | 13.03 |
| Shape 28 | linear | 5 | 10 | 30 | 5 | 16.07 |
| Shape 29 | linear | 5 | 20 | 30 | 10 | 14.37 |
| Shape 30 | linear | 5 | 25 | 30 | 12 | 13.61 |
| Shape 31 | linear | 5 | 6 | 8 | 11 | 15.98 |
| Shape 32 | linear | 5 | 6 | 15 | 6 | 16.36 |
| Shape 33 | linear | 5 | 6 | 20 | 4 | 15.33 |
| Shape 34 | linear | 5 | 6 | 50 | 3 | 14.10 |
| Shape 35 | linear | 5 | 6 | 80 | 1 | 9.84 |
| Shape 36 | linear | 5 | 6 | 110 | 1 | 7.64 |
| Shape 37 | dot | 5 | 6 | 30 | 3 | 17.06 |
| Shape 38 | dot | 5 | 6 | 30 | 2 | 15.24 |
| Shape 39 | dot | 5 | 6 | 30 | 0 | 6.31 |
| Shape 40 | dot | 5 | 6 | 30 | 0 | 1.35 |
| Shape 41 | dot | 5 | 6 | 50 | 0 | 2.31 |

DESCRIPTION OF SYMBOLS

1: uneven sheet member
2: sheet section
2*a*, 2*b*: surface of sheet section
3: uneven structure
4: uneven unit shape
5, 51: protruding part
5*a*: base portion
5*b*: weight portion
6: recessed part
7, 11: sound-insulating structural body
8: flexible member
8*a*, 8*b*: surface of flexible member
9: adherend
10: sound source
16, 17: mold
16*a*, 17*a*: cavity
18, 19: press-bonding roll
20: nozzle
21: light source
22: rib-like projection
23: rib-like projection

What is claimed is:

1. A sound-insulating structural body, comprising:

a flexible member in which a load giving a deformation rate of 4% in a compression test performed by a compression tester is 160 kPa or less;

an adherend on which the flexible member is disposed; and an uneven sheet member having an uneven structure, wherein the flexible member is provided such that it is arranged between the adherend and the uneven sheet member, and the uneven structure comprises a sheet section and protruding parts provided on a surface of the sheet section, the adherend is applied across an entire surface of one surface of the flexible member, which is an opposite surface where the uneven sheet member is positioned.

2. The sound-insulating structural body according to claim 1, wherein the protruding parts and the sheet section have a weight ratio, which is represented by (weight of protruding parts)/(weight of sheet section), of 0.7 or higher.

3. The sound-insulating structural body according to claim 1, comprising an adhesive layer between the uneven sheet member and the flexible member.

4. The sound-insulating structural body according to claim 1, wherein the sheet section has an area density of 2.5 kg/m$^2$ or less.

5. The sound-insulating structural body according to claim 1, wherein the protruding parts have a density of 100 kg/m$^3$ or more.

6. The sound-insulating structural body according to claim 1, wherein the protruding parts have a height of 0.1 mm or more.

7. The sound-insulating structural body according to claim 1, wherein the protruding parts have a number ratio of 1,000 to 10,000/m$^2$.

8. The sound-insulating structural body according to claim 1, wherein the load giving a deformation rate of 4% in the compression test performed by the compression tester is 0.15 kPa or more.

9. The sound-insulating structural body according to claim 1, wherein in the uneven sheet member, the weight ratio of the protruding parts and the sheet section, which is represented by (weight of protruding parts)/(weight of sheet section), is 5 or lower, and in the flexible member, the load giving a deformation rate of 4% in the compression test performed by the compression tester is 10 kPa or less.

10. The sound-insulating structural body according to claim 1, wherein, in the uneven sheet member, the uneven structure is provided on the surface of the side on which the flexible member exists, or the opposite side thereof.

11. The sound-insulating structural body according to claim 1, further comprising a sound source installed such that the side of the uneven sheet member faces the sound source.

12. The sound-insulating structural body according to claim 1, satisfying the conditions represented by the following equations (A) to (C) simultaneously:

$$(TL_1-TL_2)-(TL_3-TL_4)>3\text{ dB} \quad (A)$$

$$TL_1-TL_2>0\text{ dB} \quad (B)$$

$$TL_3-TL_4>0\text{ dB} \quad (C)$$

$TL_1$ (dB): sound transmission loss of the sound-insulating structural body in a case where the side of the uneven sheet member is arranged to face the sound source $TL_2$ (dB): sound transmission loss of the sound-insulating structural body in a case where, under the condition of the $TL_1$, the uneven sheet member is replaced with a smooth flat sheet having the same mass and area $TL_3$ (dB): sound transmission loss of the sound-insulating structural body in a case where the side of the adherend is arranged to face the sound source $TL_4$ (dB): sound transmission loss of the sound-insulating structural body in a case where, under the condition of the $TL_3$, the uneven sheet member is replaced with a smooth flat sheet having the same mass and area wherein the $TL_1$ and the $TL_2$ each represent the sound transmission loss at a frequency at which the value of $(TL_1-TL_2)$ is the largest, and the $TL_3$ and the $TL_4$ each represent the sound transmission loss at a frequency at which the value of $(TL_3-TL_4)$ is the largest.

13. The sound-insulating structural body according to claim 1, wherein the protruding parts linearly protrude on the sheet section, and uneven unit shapes which have the protruding parts and recessed parts extending along the protruding parts are repeatedly arrayed in one or two directions on the sheet section.

14. The sound-insulating structural body according to claim 1, wherein the flexible member comprises a nonwoven fabric.

15. The sound-insulating structural body according to claim 1, wherein the flexible member is a foamed body.

16. A sound-insulating sheet, comprising:

an uneven sheet member having an uneven structure which comprises a sheet section and plural protruding parts which protrude outwardly from provided on a surface of the sheet section; and a flexible member provided on the uneven sheet member, wherein in the flexible member, a load giving a deformation rate of 4% in a compression test performed by a compression tester is 160 kPa or less, and in the uneven sheet member, the protruding parts and the sheet section have a weight ratio, which is represented by (weight of protruding parts)/(weight of sheet section), of 0.7 or higher.

17. The sound-insulating structural body according to claim 1, wherein the protruding parts protrude outwardly from the surface of the sheet section.

18. The sound-insulating structural body according to claim 1, wherein the protruding parts satisfy the following equations (I) and (II):

$$0.1 \leq w1max \times t \times sg/w2 \leq 10 \quad \text{(I)}$$

$$5 \leq w1max \times t \leq 50 \quad \text{(II)}$$

wherein, in equation (I) and (II), sg is a specific gravity of the protruding parts, w1max (mm) is a maximum width of a lateral cross-section of the protruding parts, t (mm) is a height of the protruding parts, and w2 (mm) is a width of a recessed parts.

19. The sound-insulating structural body according to claim 1, wherein a cross-sectional shape of the protruding parts is a square shape, a rectangular shape, a trapezoidal shape, a semicircular shape, or a semielliptical shape.

* * * * *